US009057172B2

(12) United States Patent
Soucy et al.

(10) Patent No.: US 9,057,172 B2
(45) Date of Patent: Jun. 16, 2015

(54) ANCHORING SYSTEM

(71) Applicant: CICAME ENERGIE INC., Longueuil (CA)

(72) Inventors: Genevieve Soucy, Chambly (CA); Franck Willier, Mont St-Hilaire (CA); Nicolas Hillion, Chambly (CA)

(73) Assignee: CICAME ENERGIE INC., Longueuil, Quebec (CA)

( * ) Notice: Subject to any disclaimer, the term of this patent is extended or adjusted under 35 U.S.C. 154(b) by 0 days.

(21) Appl. No.: 14/167,609

(22) Filed: Jan. 29, 2014

(65) Prior Publication Data

US 2014/0208683 A1 Jul. 31, 2014

Related U.S. Application Data

(60) Provisional application No. 61/757,827, filed on Jan. 29, 2013.

(51) Int. Cl.

| | |
|---|---|
| ***E04B 1/38*** | (2006.01) |
| ***E04C 5/00*** | (2006.01) |
| ***E02D 27/42*** | (2006.01) |
| ***E02D 5/80*** | (2006.01) |
| ***E02D 17/20*** | (2006.01) |
| *E04C 5/12* | (2006.01) |
| *E04H 12/22* | (2006.01) |

(52) U.S. Cl.

CPC . *E02D 27/42* (2013.01); *E04C 5/12* (2013.01); *E04H 12/2276* (2013.01); *E04H 12/2292* (2013.01); *E04H 12/2215* (2013.01); *E02D 5/80* (2013.01); *E02D 17/20* (2013.01)

(58) Field of Classification Search

CPC ..... E02D 27/42; E02D 5/80; E02D 5/801; E04C 5/125; E04C 5/12; E04C 5/801; E04C 5/80; E04H 12/2292; E04H 12/2276; E04H 12/2215

USPC ..... 52/835, 833, 843, 298, 855, 651.04, 52/741.15, 745.04, 699, 701, 707, 712, 52/713, 714, 715, 844, 296

See application file for complete search history.

(56) References Cited

U.S. PATENT DOCUMENTS

| | | | | | |
|---|---|---|---|---|---|
| 1,486,594 | A | * | 3/1924 | Malome | 52/154 |
| RE16,494 | E | * | 12/1926 | Malone | 52/154 |
| 1,722,352 | A | * | 7/1929 | Rawley | 52/152 |
| 3,342,444 | A | * | 9/1967 | Nelson | 52/165 |
| 3,514,911 | A | * | 6/1970 | Preradovich | 52/165 |
| 4,099,354 | A | * | 7/1978 | DePirro | 52/146 |
| 4,218,858 | A | | 8/1980 | Legler | |
| 4,455,795 | A | * | 6/1984 | Cole | 52/155 |
| 5,060,435 | A | * | 10/1991 | Bogdanow | 52/292 |

(Continued)

*Primary Examiner* — Chi Q Nguyen

(74) *Attorney, Agent, or Firm* — Merchant & Gould P.C.

(57) ABSTRACT

An anchoring system for anchoring a pole to a ground surface, the anchoring system including a plurality of modules interconnectable to one another for surrounding the pole, each module including a support leg configured for extending into the ground surface so as to provide anchoring support to the pole on a given side of said pole, each module of the anchoring system further including at least two mounting interfaces disposed distally from the support leg and configured for resting against the pole, and each module of the anchoring system further including at least one connecting member extending from an edge of the support leg to a corresponding mounting interface, said the least one connecting member further operatively extending between said at least two mounting interfaces.

22 Claims, 18 Drawing Sheets

(56) References Cited

U.S. PATENT DOCUMENTS 5,133,164 A * 7/1992 Legler ..... 52/165
5,317,844 A 6/1994 Legler
6,799,401 B1 * 10/2004 Legler ..... 52/169.13
7,591,119 B2 * 9/2009 Ritz ..... 52/835
2006/0196878 A1 * 9/2006 Cook ..... 220/639

* cited by examiner

*Figure 1: Anchor's sub components*

ANCHORING SYSTEM

This application claims benefit of Ser. No. 61/757,827, filed 29 Jan. 2013 in the United States and which application is incorporated herein by reference. To the extent appropriate, a claim of priority is made to the above disclosed application.

FIELD OF THE INVENTION

The present invention relates to an anchoring system for anchoring upright structures. More particularly, the present invention relates to an anchoring system for securing a pole or any other similar vertical structure onto a ground surface, for example.

BACKGROUND

It is sometimes necessary to mount "upright" (i.e. vertical, slanted, etc.) structures, such as telephone, electricity, or utility poles, and to secure these in place. In some instances, it is not possible to secure the base of these structures within the ground. This occurs in situations where the ground is too difficult to excavate, where space is limited, or where inserting structures into the ground is simply not suitable. In these situations, the upright structure can be mounted on top of the ground, and it must be secured to resist, among other influences, the moment loads imposed about the base of the structure by forces acting upon the rest of the structure (e.g. wind, snow, objects, etc.).

It is known in the art to secure these structures in place using anchors, which are attached to the structure, and which can be bored and/or inserted into the ground. The following US patents provide examples of such anchors:

U.S. Pat. No. 4,218,858 issued to LEGLER on Aug. 26, 1980 relates to a tri-anchor bracket for poles. Namely, this documents describes an anchor bracket for securing an article on a support surface. The anchor bracket comprises a clamp device for securement to the article and at least two anchor rods for anchoring in hard ground such as rock. Each of the anchor rods has a top end and a bottom end section with the bottom end section having an expanding end. A securement sleeve is provided about the bottom end section of each anchor rod and has at least an expandable section whereby the expandable section of the securement sleeve will be caused to expand by relative axial displacement with the expanding end of the anchor rod for anchoring the bottom end section in a hole of proper cross-section extending through the surface. The clamp device is attachable to the anchor rods for securement of the article on the support surface.

U.S. Pat. No. 5,317,844 also issued to LEGLER on Jun. 7, 1994 relates to a universal pole anchoring device. Indeed, this document describes a universal pole anchoring device for supporting utility poles vertically over a hard surface such as rock, concrete or the like. The device comprises a harness assembly connected about a base section of a pole to be supported on the hard surface. The harness is secured by bolts all about the base section. The harness assembly is comprised of harness members each defined by an anchor bolt attachment pipe having a pair of pole engaging clamps connected thereto in spaced alignment. The clamps support the attachment pipe spaced from and at an outwardly depending angle when the harness is secured to a pole. The harness assembly also has a predetermined number of harness numbers interconnected by the connecting bolts about the base section and dependent on the diameter of the pole. An anchor bolt assembly is connectible to each of the attachment pipes of the harness members to anchor the harness assembly in the hard surface to support the pole vertically thereover.

Some disadvantages of known anchors include: a) they are often not suitable for vertical structures made of composite materials or materials other than wood, such as fiberglass or metals; b) they may not provide sufficient support for newer vertical structures which are increasingly taller than older vertical structures, and which can impose higher loads due to their increased heights; c) conversely, known anchors need to be enlarged and/or extended to support increasingly taller vertical structures, which can significantly add to material costs, labor associated with the installation of the anchors, and complexity; d) etc.

Hence, in light of the aforementioned, there is a need for an improved device or system which, by virtue of its design and components, would be able to overcome or at least minimize some of the aforementioned prior art problems.

SUMMARY

An object of the present invention is to provide anchoring device or system which would be an improvement over other related anchoring devices, systems and/or methods known in the prior art.

In accordance with the present invention, the above object is achieved, as will be easily understood from the present description, with an anchoring device or system such as the one briefly described herein and such as the one exemplified in the accompanying drawings.

According to an aspect of the present invention, there is provided an anchoring system for anchoring a pole to a ground surface, the anchoring system comprising a plurality of modules interconnectable to one another for surrounding the pole, each module comprising a support leg configured for extending into the ground surface so as to provide anchoring support to the pole on a given side of said pole, each module of the anchoring system further comprising at least two mounting interfaces disposed distally from the support leg and configured for resting against the pole, and each module of the anchoring system further comprising at least one connecting member extending from an edge of the support leg to a corresponding mounting interface, said the least one connecting member further operatively extending between said at least two mounting interfaces.

According to another aspect of the present invention, there is also provided an anchoring device for anchoring a vertical structure to a ground surface, the anchoring device comprising a plurality of support legs for extending into the ground surface so as to provide anchoring support and for attaching to the vertical structure, each support leg comprising a link extending between a length of said support leg and a plurality of discrete mounting interfaces, the link spanning between each mounting interface thereby forming a continuous connection between the mounting interfaces and said support leg, each mounting interface configured for removably attaching to the vertical structure, thereby anchoring the vertical structure to the ground surface.

In some optional embodiments, the support legs are hollow tubes, which can be cylindrical, rectangular, or any other suitable shape, and which can be made of steel, hard polymers, or any other suitable material or combination thereof. Optionally, the support legs can be inclined relative to the vertical, or can be straight. Further optionally, at least two, and preferably three or four, support legs are disposed equidistantly about the perimeter of the vertical structure.

In some optional embodiments, the mounting interface can consist of a curved surface substantially matching the profile of the surface of the vertical structure. The mounting interface can connect to other similar mounting interfaces on other support legs, thereby connecting all support legs together.

According to another aspect of the present invention, there is also provided a vertical structure (ex. pole) equipped with the above-mentioned anchoring device or system.

According to another aspect of the present invention, there is also provided a kit with components for assembling the above-mentioned anchoring device, system and/or vertical structure.

According to yet another aspect of the present invention, there is also provided a set of components for interchanging with components of the above-mentioned kit.

According to yet another aspect of the present invention, there is also provided a method of using and/or assembling components of the above-mentioned anchoring device, system, vertical structure, kit and/or set.

According to yet another aspect of the present invention, there is also provided a method of doing business with the above-mentioned anchoring device, system, vertical structure, kit, set and/or method(s).

Some objects, advantages and other features will become more apparent upon reading the following non-restrictive description of certain optional embodiments, given for the purpose of exemplification only, with reference to the accompanying drawings.

DETAILED DESCRIPTION OF OPTIONAL EMBODIMENTS

Figure 4:
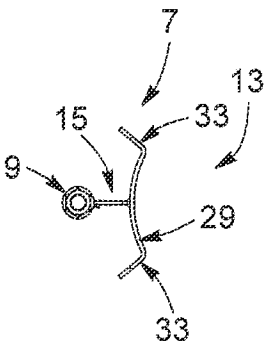
FIG. 4 is a top plan view of what is shown in FIG. 3.
Figure 3:
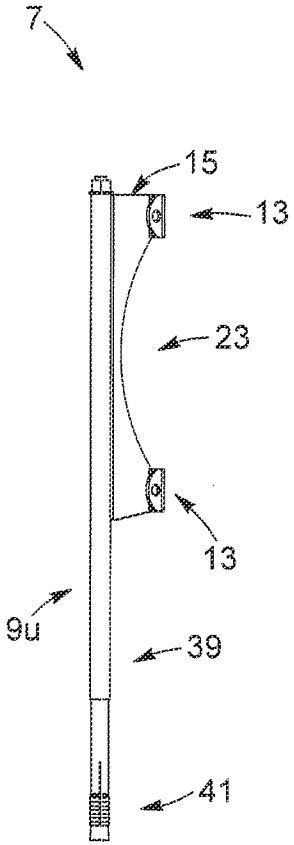
FIG. 3 is a side elevational view of an upright anchoring module with two mounting interfaces according to a possible embodiment of the present invention.
Figure 2:
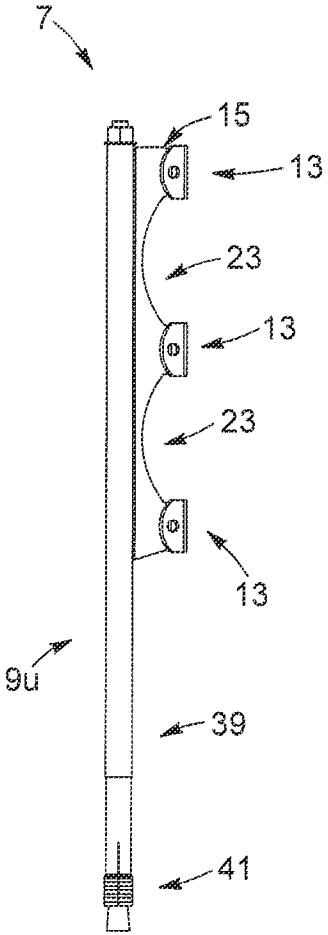
FIG. 2 is an elevational view of an upright anchoring module with three mounting interfaces according to a possible embodiment of the present invention.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Furthermore, although the present anchoring device and/or system was primarily designed to anchor an upright or "vertical" structure, such a pole for example, onto a ground surface, it may be used with other objects and/or in other types of applications, as apparent to a person skilled in the art. For this reason, expressions such as "anchor", "upright structure", "vertical structure", "pole", "ground surface", etc. as used herein should not be taken as to limit the scope of the present invention and includes all other kinds of objects, applications and/or purposes with which the present invention could be used and may be useful. Indeed, the use of the term "vertical" herein to describe the structure does not limit the device to being used only with structures being "perpendicular" to the surface. For this reason, expressions such as "upright", "straight", "erect", "raised", "inclined", "slanted", etc. can be used interchangeably with the term "vertical".

Moreover, in the context of the present invention, the expressions "system", "kit", "assembly", "device", "module", "product" and "unit", as well as any other equivalent expressions and/or compounds word thereof known in the art will be used interchangeably, as apparent to a person skilled in the art. This applies also for any other mutually equivalent expressions, such as, for example: a) "anchoring", "supporting", "grounding", "erecting", "maintaining", etc.; b) "upright structure", "vertical structure", "pole", "pipe", "tube", etc.; c) "ground surface", "working surface", "hard surface", "rock surface", etc.; d) "connecting member", "connector member", "flange", "link", "body", "extension", "web", etc.; e) "interconnecting", "bridging", "supporting", "retaining", "strengthening", etc.; f) "mounting interface", "mounting surface", "saddle", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of a pole for example, or the centerline of a bore, for example, and that expressions such as "connected" and "connectable", or "mounted" and "mountable", may be interchangeable, in that the present invention also relates to a kit with corresponding components for assembling a resulting fully assembled and operational anchoring system (and/or an upright or "vertical" structure anchored and/or erected with the same).

In addition, although the optional configurations as illustrated in the accompanying drawings comprise various components and although the optional configurations of the device and corresponding system as shown may consist of certain geometrical configurations and/or dimensions as explained and illustrated herein, not all of these components, geometries and/or dimensions are essential and thus should not be taken in their restrictive sense, i.e. should not be taken as to limit the scope of the present invention. It is to be understood that other suitable components and cooperations thereinbetween, as well as other suitable geometrical configurations and/or dimensions may be used for the device/system, and corresponding parts, as briefly explained and as can be easily inferred herefrom, without departing from the scope of the invention.

LIST OF REFERENCE NUMBERS FOR SOME OF THE CORRESPONDING OPTIONAL COMPONENTS ILLUSTRATED IN THE ACCOMPANYING DRAWINGS

1. anchoring system
3. pole
5. ground surface
7. anchoring module
7*a*. first anchoring module
7*b*. second anchoring module.
7*c*. third anchoring module
7*d*. fourth anchoring module
7*n*. $n^{th}$ anchoring module
9. support leg
9*u*. upright support leg
9*s*. slanted support leg
11. side (of pole.)
11*a*. first side (of pole)
11*b*. second side (of pole)
11*c*. third side (of pole)
11*d*. fourth side (of pole)
11*n*. $n^{th}$ side (of pole)
13. mounting interface
13*a*. first mounting interface (or "upper" mounting interface)
13*b*. second mounting interface (or "lower" mounting interface)
13*c*. third mounting interface (or "lowest" mounting interface)

13*n*. $n^{th}$ mounting interface
15. connecting member
15*a*. first connecting member (or "upper" connecting member)
15*b*. second connecting member (or "lower" connecting member)
15*c*. third connecting member (or "lowest" connecting member)
15*n*. $n^{th}$ connecting member
17. edge (of support leg)
19. support leg section
21. welding strand
23. arcuate segment
23*a*. first arcuate segment
23*b*. second arcuate segment
23*c*. third arcuate segment
23*n*. $n^{th}$ arcuate segment
25. arc member
27. span
27*a*. first span (of first connecting member)
27*b*. second span (of second connecting member)
27*c*. third span (of third connecting member)
27*n*. $n^{th}$ span (of $n^{th}$ connecting member)
29. mounting surface
31. extremity
33. wing
35. vertical axis (of pole)
37. tube (of support leg)
39. ground surface end
41. gripping mechanism
43. anchoring assembly
45. module component
47. field component
49. rod with flared cone
51. expansion shell
53. pipe
55. washer
57. nut
59. stud
61. nut
63. lag bolt
65. chart
67. drilling template
67*a*. first template module
67*b*. second template module
67*c*. third template module
67*d*. fourth template module
67*n*. $n^{th}$ template module
69. butt
71. hard working surface (of ground surface)
73. assembled template
75. hole (being drilled into the ground)
77. anchor
79. hole (of mounting interface for securing against pole)
81. hole (of mounting interface for interconnecting to another interface)

Broadly described, the present invention, as exemplified in the accompanying drawings, relates to an anchoring system (1) for anchoring a pole (3) to a ground surface (5), the anchoring system (1) comprising a plurality of modules (7) interconnectable to one another for surrounding the pole (3), each module (7) comprising a support leg (9) configured for extending into the ground surface (5) so as to provide anchoring support to the pole (3) on a given side (11) of said pole (3), each module (7) of the anchoring system (1) further comprising at least two mounting interfaces (13) disposed distally from the support leg (9) and configured for resting against the pole (3), and each module (7) of the anchoring system (1) further comprising at least one connecting member (15) extending from an edge (17) of the support leg (9) to a corresponding mounting interface (13), said the least one connecting member (15) further operatively extending between said at least two mounting interfaces (13).

The at least one connecting members (15) can come in various shapes and configurations, possible embodiments being illustrated in FIGS. 40-49, for example.

Indeed, as can be easily understood when referring to these figures and other accompanying drawings, and contrary to the anchoring devices of the prior art where connecting members are used simply and solely to bridge (i.e. interconnect, etc.) a mounting interlace to the support leg, the anchoring device of the present system (1) provides at least one connecting member (15) positioned, shaped and sized to bridge not only the support leg (9) to its corresponding and distally opposite given mounting interface (13), but also, and very innovatively, to bridge (i.e. interconnect, etc.) this very same given mounting interface (13) to an adjacent (i.e. neighboring, subsequent, etc.) mounting interlace (13), whether this latter mounting interface (13) be directly or remotely above, and/or directly or remotely below (see mounting interface 13*c*, for example) with respect to the aforementioned given mounting interface (13).

For example, and as can be easily understood in the accompanying drawings, the at least one connecting member (15) of a first mounting interlace (13*a*) may comprise a sub-portion (15*a*) connecting the first mounting interface (13*a*) to the support leg (9) and another sub-portion (15*b*) operatively connecting the first mounting interface (13*a*) to a second adjacent mounting interface (13*b*).

The at least one connecting member (15) of the first mounting interface (13*a*) may comprises the aforementioned sub-portion (15*a*) connecting the first mounting interface (13*a*) to the support leg (9) but also another sub-portion (15*c*) operatively connecting the first mounting interface (13*a*) to a third subsequent lower mounting interface (13*c*).

Optionally also, the at least one connecting member (15) of a given first mounting interface (13*a*, 13*b*, 13*c*) may comprise a sub-portion (15*a*, 15*b*, 15*c*) connecting said given first mounting interlace (13*a*, 13*b*, 13*c*) to the support leg (9) and another sub-portion (15*a*, 15*b*, 15*c*) directly connecting said given first mounting interface (13*a*, 13*b*, 13*c*) to at least one other mounting interface (13*a*, 13*b*, 13*c*) of the anchoring module (7), as illustrated in FIGS. 40-49, for example.

In doing so, and among different resulting advantages, if a given mounting interface (13) of the present anchoring system (1) is subject to a given tension or compression force due to a given moment acting on the pole (3), this given force will be distributed via the present connecting member (15) to only the given mounting interface (13), but also adjacent (i.e. neighboring, subsequent, etc.) mounting interfaces (13*a*, 13*b*, 13*c*, etc.), thereby enabling the present anchoring device and system (1) to withstand higher loads and moments than what is possible with conventional anchoring devices.

Indeed, as can also be easily understood, contrary to the anchoring devices of the prior art which provide an "open" structure, typically being "U-shaped" formed by a) a first connecting member (of a first mounting interface), b) a segment of the support leg, and c) a second connecting member (of a first mounting interface), the present anchoring system (1) provides a "closed-loop" structure, formed by a) a first connecting member (15*a*) (of a first mounting interface 13*a*), b) a segment of the support leg (9), c) a second connecting member (15*b*) (of a second mounting interface 13*b*), and d) one of said connecting members (15*a*, 15*b*) (and/or both connecting members) further connecting the first mounting interface (13*a*) to the second mounting interface (13*b*) (and/or vice-versa).

Figure 48:
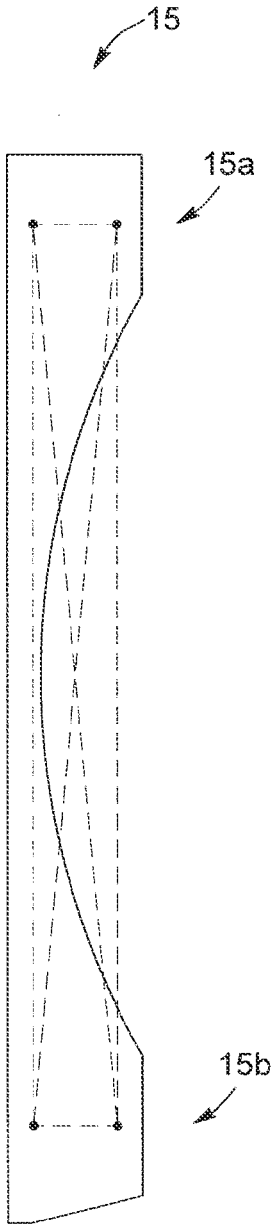
FIG. 48 is an enlarged view of the at least one connecting member shown in FIG. 44, and schematically representing how this at least one connecting member provides various connection points for a resulting polygonal and/or truss-like structure to be used with the anchoring system according to a possible embodiment of the present invention.
Figure 49:
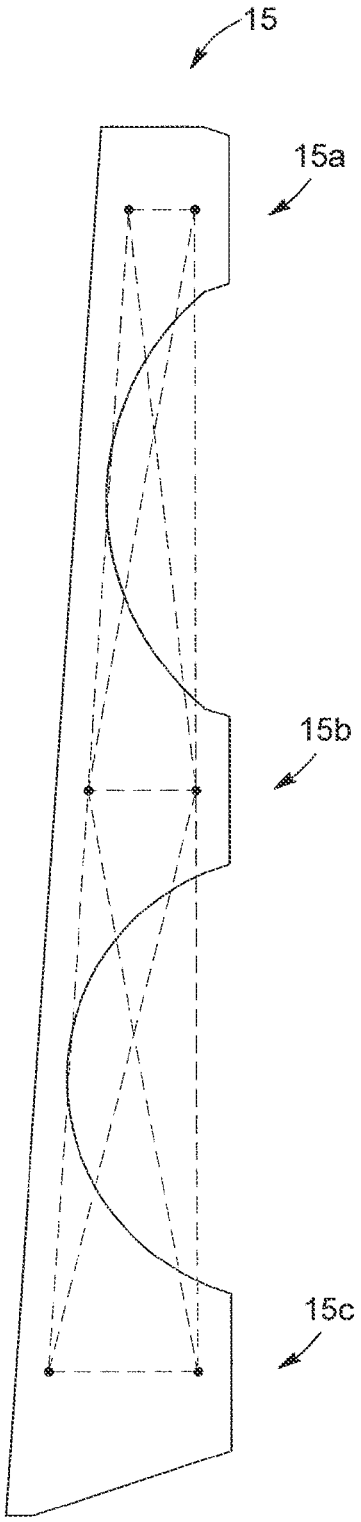
FIG. 49 is an enlarged view of the at least one connecting member shown in FIG. 47, and schematically representing how this at least one connecting member provides various connection points for a resulting polygonal and/or truss-like structure to be used with the anchoring system according to a possible embodiment of the present invention.

As can also be easily understood, this "closed-loop" configuration (and/or the corners and/or connection points thereof) of the connecting member (15) according to the present system (1) can take on various shapes of polygons, whether triangular, trapezoidal, parallelogram, rectangular, square, etc., or take on various other shapes and forms (ex. truss-like, etc.), as illustrated in FIGS. 48 and 49 for example (the same could be said for other connecting members (15) shown in the accompanying figures and/or for other possible types of connecting members (15) that could be used with the present system (1)). Namely, in the example of the connecting member (15) shown in FIG. 49, it is schematically illustrated how this very same/single connecting member (5) provides a variety of different resulting geometrical strengthening structures (whether triangular, trapezoidal, truss-like, etc.), something that is not possible with conventional anchoring devices listed in the background section of the present application.

As can be easily understood when referring to FIGS. 9-24 and 40-49 for example, each connecting member (15) comprising a support-leg section (19) extending along a segment of the edge (17) of the support leg (9), and according to a possible embodiment of the present system (1), support-leg sections (19) of adjacent connecting members (15) may form a continuous link between said adjacent connecting members (15).

According to one alternative, the at least one connecting member (15) is a single connecting member (15) interconnecting the at least two mounting interfaces (13).

Optionally, the single connecting member (15) can be welded to the edge (17) of the support leg (9). In such a case, the single connecting member (15) can be welded to the edge (17) of the support leg (9) by means of discrete welding strands (21), or alternatively, the single connecting member (15) can be welded to the edge (17) of the support leg (9) by means of a continuous welding strand (21), as better shown in FIGS. 9-24.

According to one possible embodiment, the single connecting member (15) includes at least one arcuate segment (23) opposite to the edge (17) of the support leg (9), and extending between adjacent mounting interfaces (13). Optionally, the at least one arcuate segment (23) extends between adjacent first and second mounting interfaces (13*a*, 13*b*).

As better shown in FIGS. 17-28, in the case where the module (7) comprises three mounting interfaces (13), the single connecting member (15) may comprise first and second arcuate segments (23*a*,23*b*), the first arcuate segment (23*a*) extending between first and second adjacent mounting interfaces (13*a*, 13*b*), and the second arcuate segment (23*b*) extending between second and third adjacent mounting interfaces (13*b*, 13*c*).

Indeed, it can be easily understood that the module (7) according to the present invention may comprise a plurality of different mounting interfaces (13) may use two, three, four or even more mounting interfaces (7), and in such a case, there is preferably a corresponding number of arcuate segments (23) extending between adjacent mounting interfaces (13), so that according to other possible embodiments of the present system (1), wherein n is the number of mounting interfaces (13), and n−1 is the number of the at least one arcuate segment (23) extending thereinbetween; n being greater than or equal to 2.

As can be easily understood when referring to the accompanying drawings, and according to an optional embodiment of the present system (1), the at least one arcuate segments (23) may have an arc member (25) extending between adjacent connecting members.

According to one possible embodiment, as better exemplified in FIGS. 1-4, 9-12 and 17-20, at least one given module (7) of the system may comprise an "upright" support leg (9*a*) configured to be substantially parallel relative to the pole (3) when anchored into the ground surface (5). Optionally also, this given module (7) comprises at least top and bottom mounting interfaces (13*a*, 13*b*), with a lower connecting member (15*b*) having a span (27*a*) substantially equal to a span (27*a*) of a corresponding upper connecting member (15*a*).

According to another possible embodiment, as better exemplified in FIGS. 5-8, 13-16 and 21-24, at least one given module (7) of the system (1) may also comprise a "slanted" support leg (9*s*) configured to be inclined relative to the pole (3) when anchored into the ground surface (5). Optionally also, this given module (7) comprises at least top and bottom mounting interfaces (13*a*, 13*b*), with a lower connecting member (15*b*) having a span (27*a*) longer than a span (27*a*) of a corresponding upper connecting member (15*a*).

As can be easily understood from the accompanying drawings, and the present description, the system (1) may use two, three, four or any other suitable number of modules (7) so as to properly conveniently surround the pole (3), whether equidistantly or in an irregular pattern. Indeed, depending on the particular applications for which the system (1) is intended for, the pole (3) to be used therewith, the different forces acting on said pole (3) and corresponding modules (7), and various other factors, as can be easily understood by a person skilled in the art, different number of modules (7), interconnecting with one another in different possible combinations, is contemplated with the present system (1).

As way of an example, and according to one possible embodiment, the system (1) comprises at least two modules (7) being interconnectable to one another for surrounding the pole (3), each support leg (9) of the system (1) being separated from an adjacent support leg (9) by an angular interval of about 180° upon the mounting interfaces (13) of each support leg (9) being secured to the pole (3).

Figure 38:
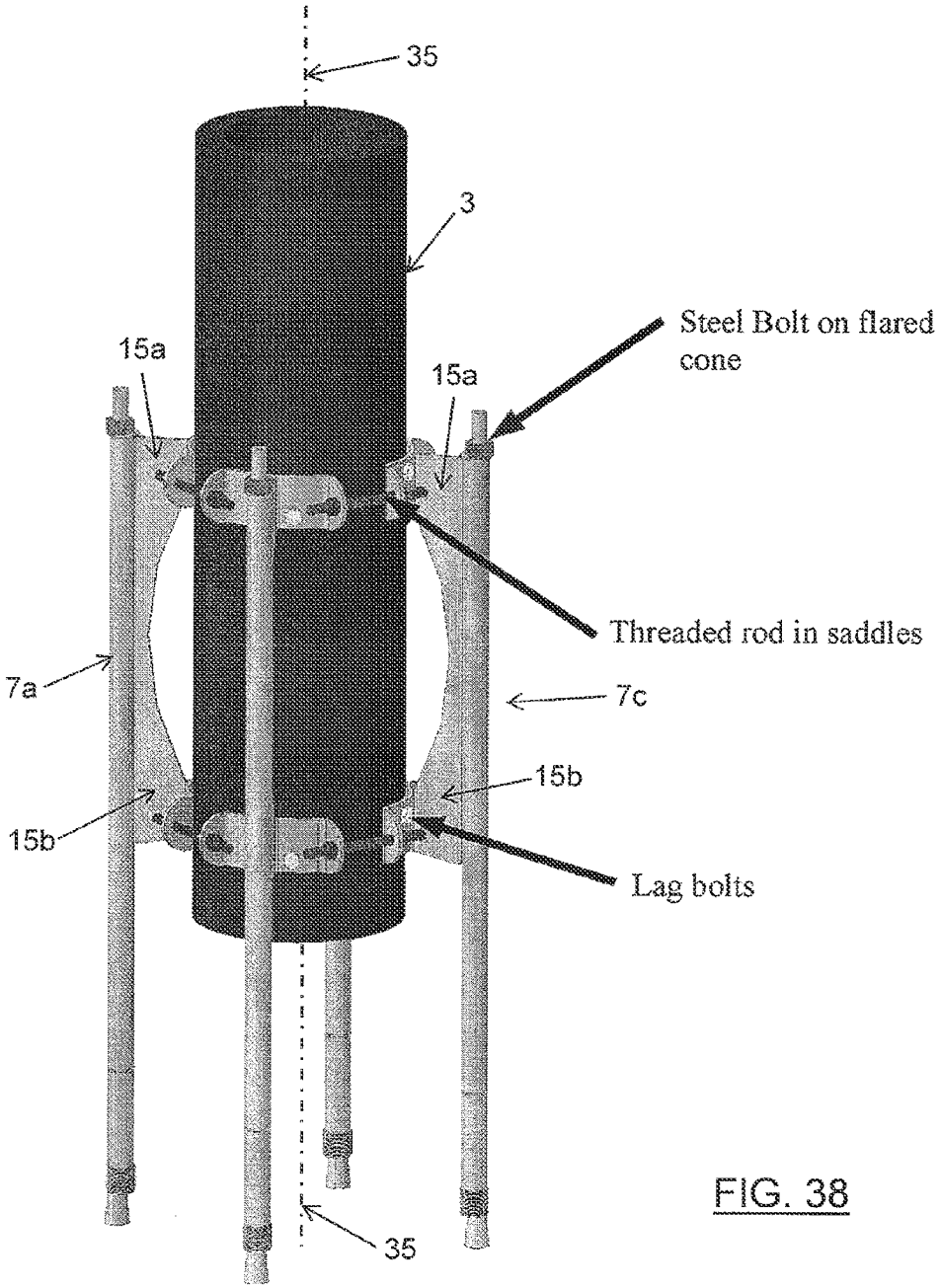
FIG. 38 is a partial schematic view of a tube being anchored by means of a plurality of modules of an anchoring system according to a possible embodiment of the present invention.

According to another possible embodiment (see FIGS. 5 and 38 for example), the system (1) comprises at least three modules (7) being interconnectable to one another for surrounding the pole (3), each support leg (9) of the system (1) being separated from an adjacent support leg (9) by an angular interval of about 120° upon the mounting interfaces (13) of each support leg (9) being secured to the pole (3).

According to another possible embodiment, the system (1) comprises at least four modules (7) being interconnectable to one another for surrounding the pole (3), each support leg (9) being separated from an adjacent support leg (9) by an angular interval of about 90° upon the mounting interfaces (13) of each support leg (9) being secured to the pole (3).

Similarly to what was discussed before and as can be easily understood, whether the system (1) employs two modules (7), three modules (7), four modules (7) or a greater number of modules (7), in the event where the system (1) comprises n modules (7) being interconnectable to one another for surrounding the pole (3), n being the number of support legs (9), each support leg (9) can be separated from an adjacent support leg (9) by an angular interval of about 360°/n upon the mounting interfaces (13) of each support leg (9) being secured to the pole (3), n being greater than or equal to 2.

According to an alternative embodiment of the system, each support leg (9) may be separated from an adjacent support leg (9) by an irregular angular interval upon the mounting interfaces (13) of each support leg (9) being secured to the pole (3).

As can be easily understood when referring to the accompanying drawings, each mounting interface (13) comprises a mounting surface (29) for engaging with a surface of the pole (3). It is worth mentioning that the expression "engaging" may encompass various forms of interaction with the pole (3), from a simplest form, where "engaging" would mean that the mounting surface (29) is intended to abut or simply rest against the pole (3), to a more elaborate cooperation, where the mounting surface (29) could be designed so as to positively engage or interact with either a surface, or a component of the pole for a positive mechanical engagement, for example, or any other suitable interaction depending on the applications for which the present system is intended for, and desired results.

According to one possible embodiment, taken in its simplest form, and as exemplified in the accompanied drawings, the mounting surface (29) has a curvature substantially corresponding to a curvature of the surface of the pole (3) because the mounting surface (29) is meant to have a curvature substantially corresponding to a curvature of the corresponding surface of the pole (3) intended to be anchored with the present system (1). Thus, the mounting interface (29) according to the present system (1) is usually referred to as a "saddle".

According to one possible embodiment, each mounting interface (13) has opposed extremities (31), each extremity (31) being provided with a wing (33) extending away from said extremity (31), each wing (33) of a given mounting interface (13) of a first support leg (9) being configured for interconnecting with a corresponding wing (33) of a mounting interface (13) of an adjacent second support leg (9).

According to one possible embodiment, each support leg (9) includes a cylindrical hollow-tube (37) between about 5-feet and about 6-feet long, and has a diameter between about 1.5 inches and about 3 inches.

Figure 1:
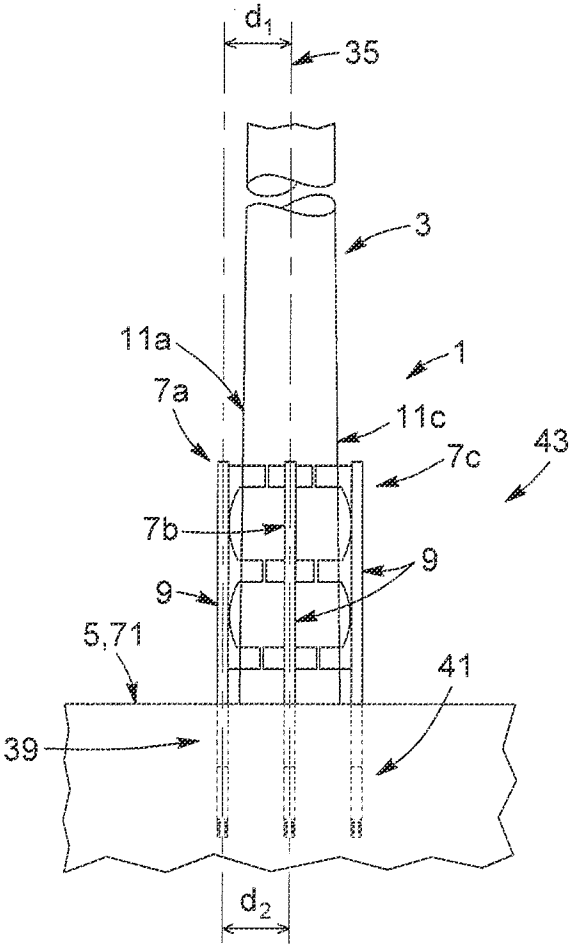
FIG. 1 is a partial schematic view of a pole being anchored to a ground surface by means of a plurality of modules of an anchoring system according to a possible embodiment of the present invention.
Figure 8:
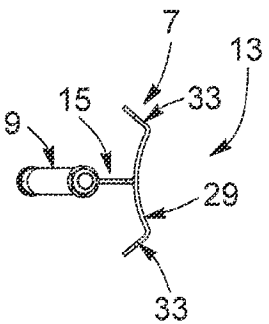
FIG. 8 is a top plan view of what is shown in FIG. 7.
Figure 7:
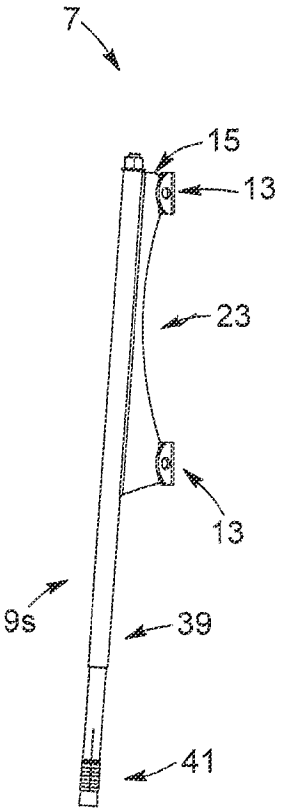
FIG. 7 is a side elevational view of a slanted anchoring module with two mounting interfaces according to a possible embodiment of the present invention.
Figure 6:
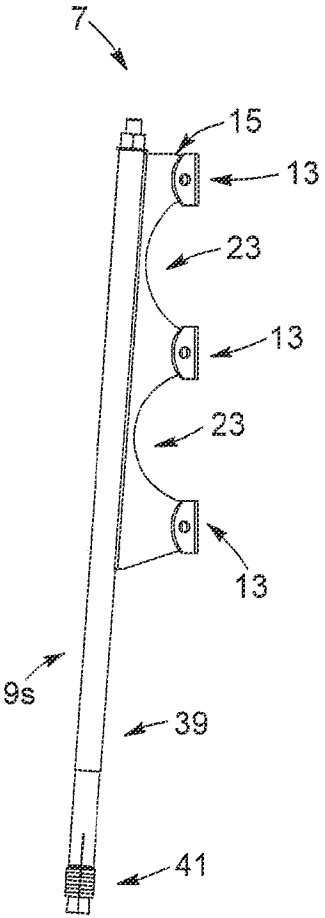
FIG. 6 is an elevational view of a slanted anchoring module with three mounting interfaces according to a possible embodiment of the present invention.
Figure 5:
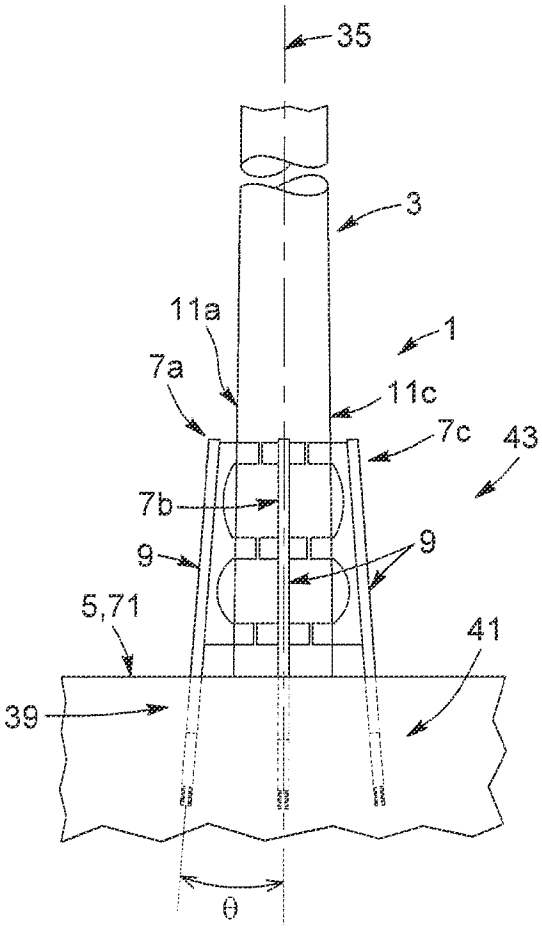
FIG. 5 is a partial schematic view of a pole being anchored to a ground surface by means of a plurality of modules of an anchoring system according to another possible embodiment of the present invention.
Figure 12:
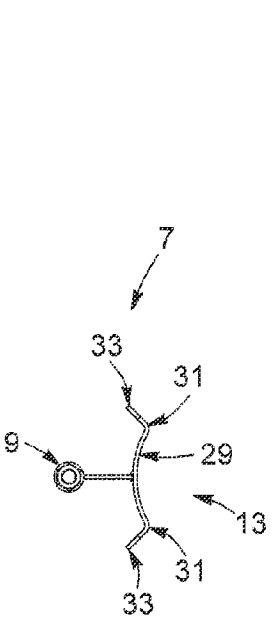
FIG. 12 is a top plan view of what is shown in FIG. 9.
Figure 11:
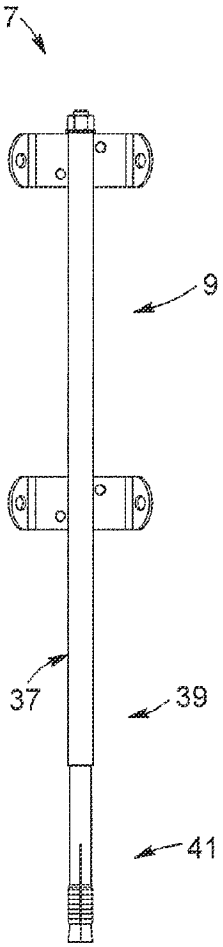
FIG. 11 is a rear elevational view of what is shown in FIG. 9.
Figure 10:
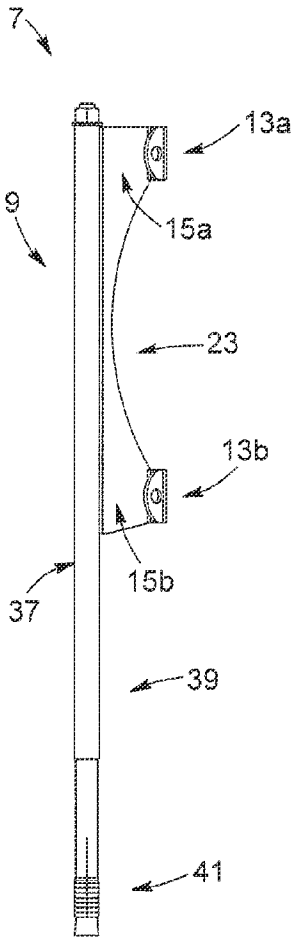
FIG. 10 is a side elevational view of what is shown in FIG. 9.
Figure 9:
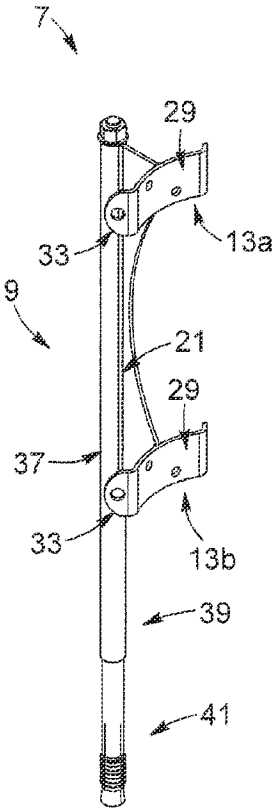
FIG. 9 is a front perspective view of an upright anchoring module with two mounting interfaces according to a possible embodiment of the present invention.
Figure 16:
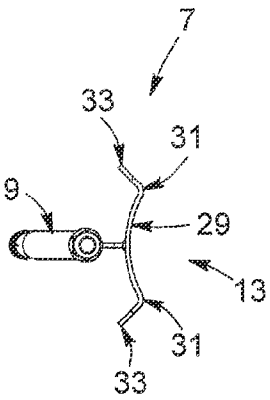
FIG. 16 is a top plan view of what is shown in FIG. 13.
Figure 15:
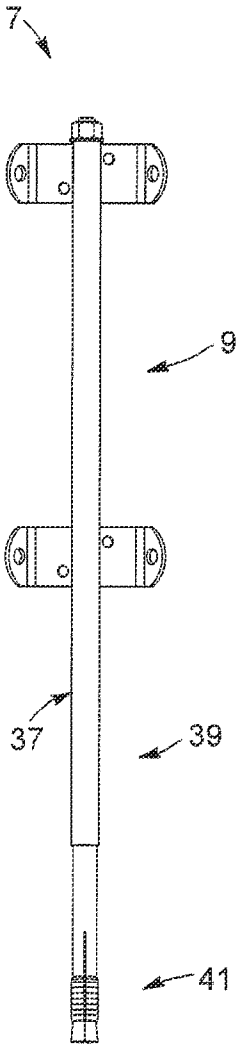
FIG. 15 is a rear elevational view of what is shown in FIG. 13.
Figure 14:
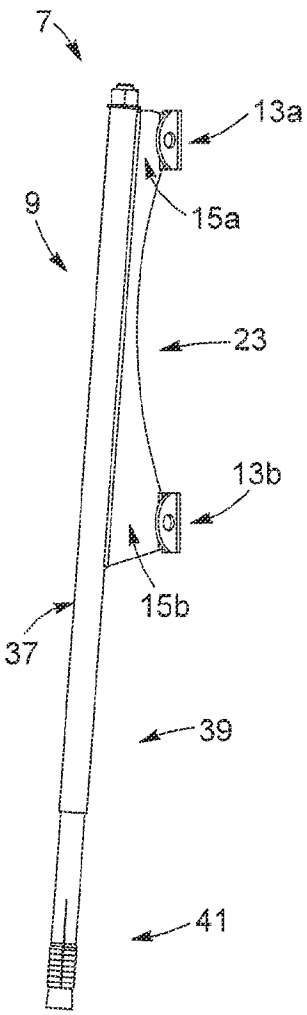
FIG. 14 is a side elevational view of what is shown in FIG. 13.
Figure 13:
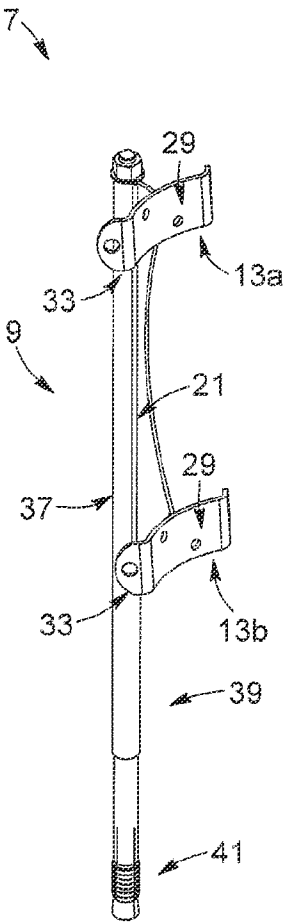
FIG. 13 is a front perspective view of a slanted anchoring module with two mounting interfaces according to a possible embodiment of the present invention.
Figure 20:
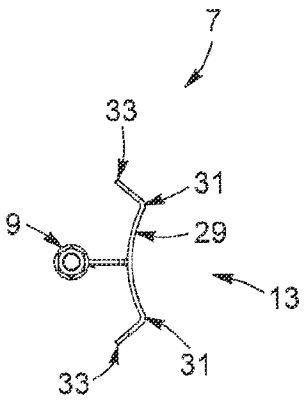
FIG. 20 is a top plan view of is shown in FIG. 17.
Figure 19:
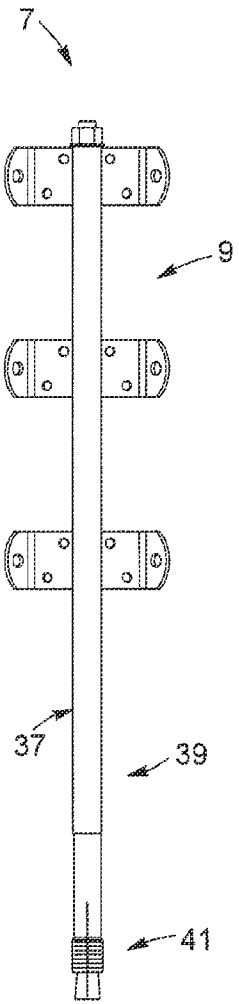
FIG. 19 is a rear elevational view of what is shown in FIG. 17.
Figure 18:
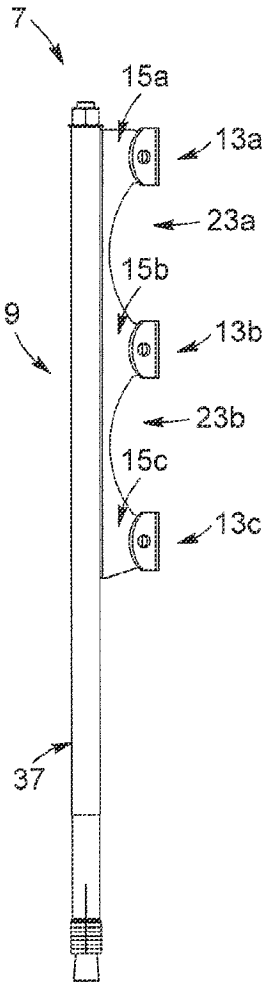
FIG. 18 is a side elevational view of what is shown in FIG. 17.
Figure 17:
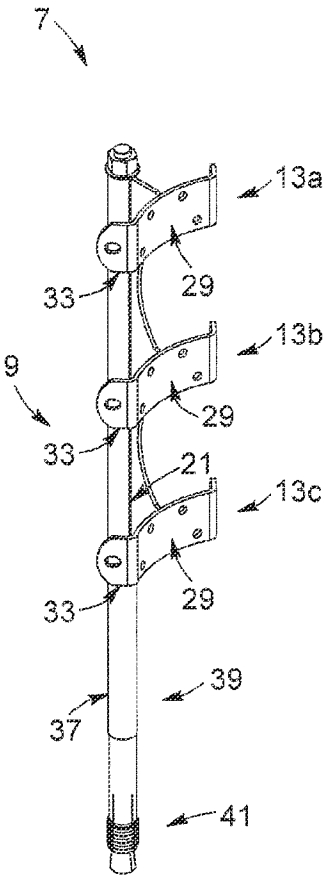
FIG. 17 is a front perspective view of an upright anchoring module with three mounting interfaces according to a possible embodiment of the present invention.
Figure 36:
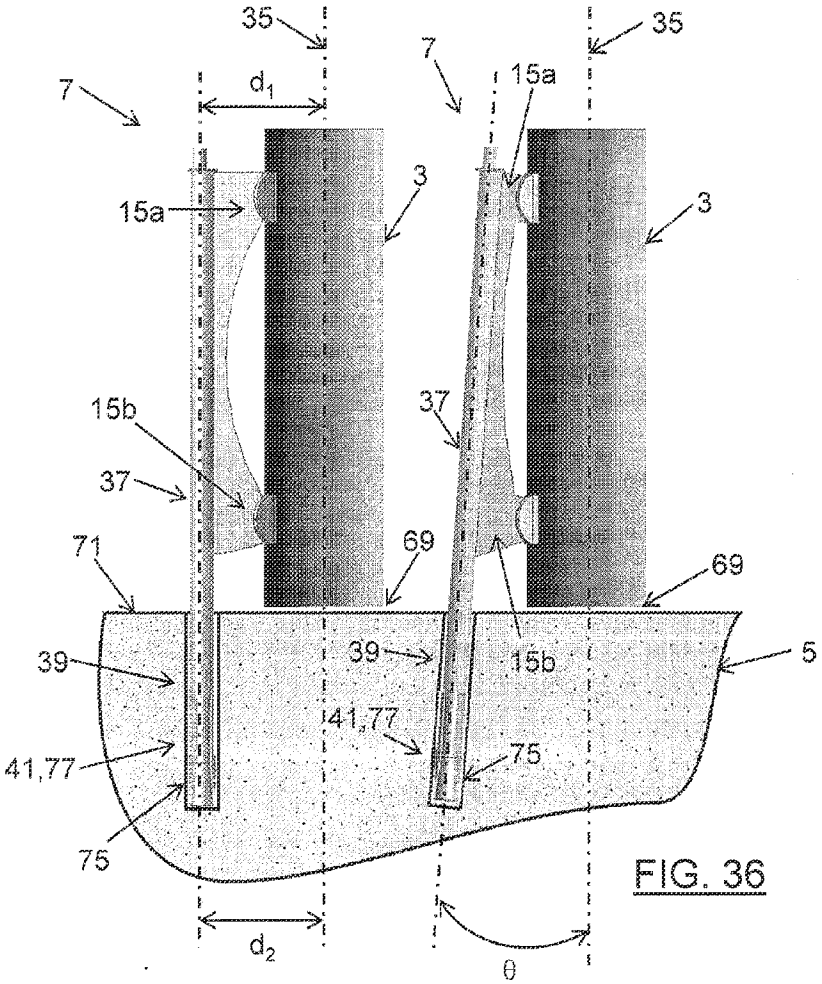
FIG. 36 is a partial schematic view of a pair of poles being anchored to a ground surface, the pole on the left being shown anchored by means of a straight anchoring device/module according to a possible embodiment of the present invention, and the pole on the right being shown anchored by means of a slanted anchoring device/module according to a possible embodiment of the present invention.

As can also be easily understood when referring to the accompanying drawings, and FIGS. 1, 5 and 36, in particular, each support leg (9) can be inclined at a support leg angle (a) relative to a vertical axis (35) of the pole (3). According to one possible embodiment, the support leg angle (e) ranges between about 0° and about 10°.

Optionally also, each support leg (9) comprises a ground-surface end (39) being securable into the ground surface (5), and may also comprise a gripping mechanism (41) for gripping into the ground surface (5), as shown in FIGS. 1, 5 and 36.

According to another aspect of the present invention, there is also provided an anchoring assembly (43) for anchoring a pole (3) to a ground surface (5), the anchoring assembly (43) comprising: a) at least one anchoring system (1) such as the one described herein; and b) at least one module component (45) configured for use with said at least one anchoring system (1).

According to one possible embodiment, at least one module component (45) is selected from the group consisting of forge anchor bolt (49), expansion shell (51), welded pipe (53), washer (55) and nut (57).

Figures 37, 37A:
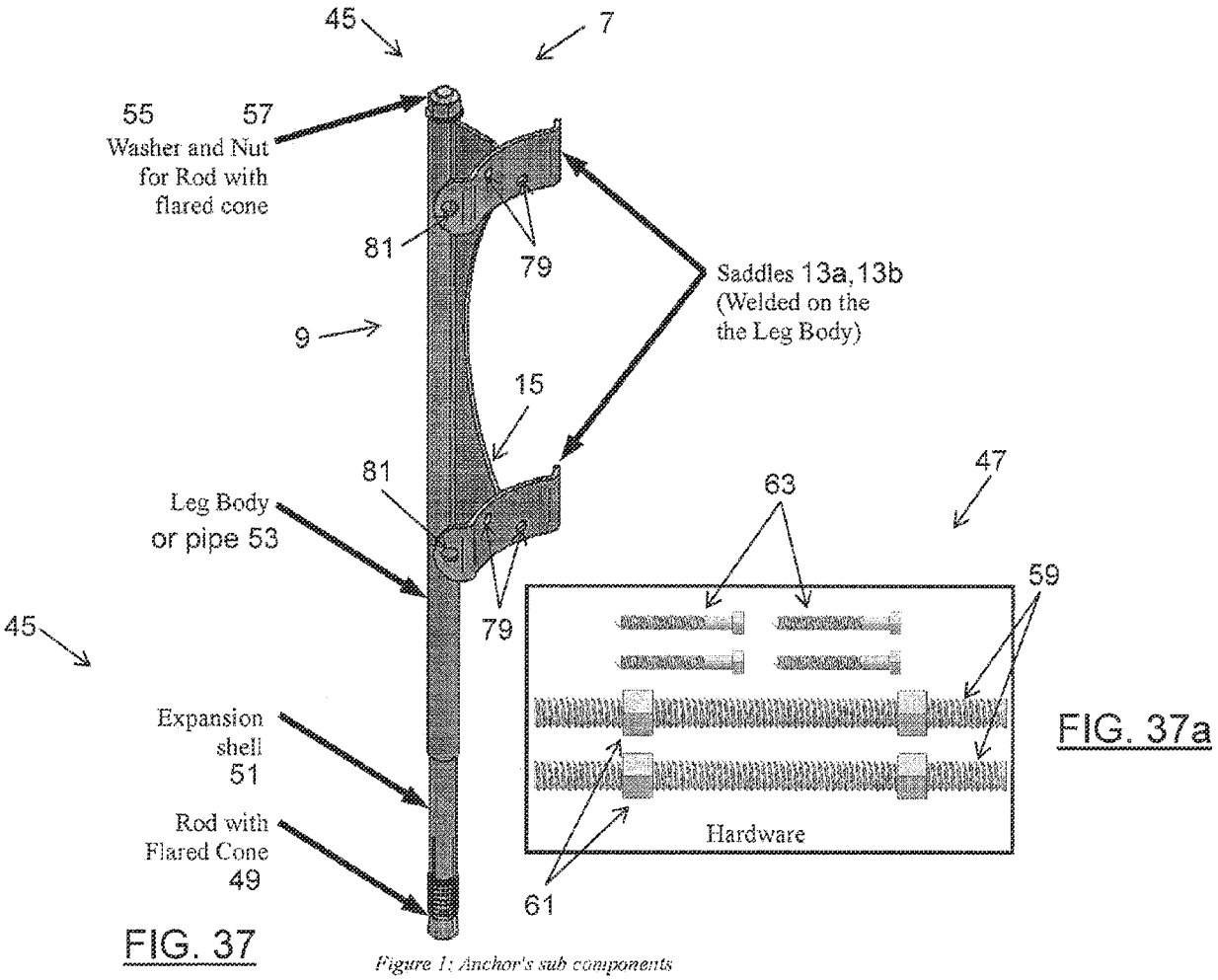
FIG. 37 is a front perspective view of an upright anchoring module with two mounting interfaces according to a possible embodiment of the present invention, the anchoring module being shown with a rod with flared cone, along with an expansion shell, a leg body, a washer and nut for the rod with flared cone, and a pair of saddles being illustrated as welded on the leg body.
FIG. 37*a* is a side view of possible complementary components to be used with an anchoring module according to a possible embodiment of the present invention.

Optionally, the anchoring assembly (43) may also comprise at least one field component (47) configured for use with the at least one module component (45), the at least one field component (47) being selected from the group consisting of stud (59), nut (61) and lag bolt (63). According to one possible embodiment of the system, the at least one field component (47) comprises at least one pair of studs (59), at least one pair of nuts (61) and at least four lag bolts (63) for each anchoring module (7) of the anchoring system (1), as can be easily understood from FIGS. 37-39.

The anchoring assembly (43) could be commercializes separately or may also comprise at least one pole (3) to be anchored to the ground surface (5).

According to yet another aspect of the present invention, there is also provided a method of anchoring a pole (3) and corresponding butt (69) to a ground surface (5), wherein the method comprises the steps of: a) evaluating parameters of the ground surface (5); b) manipulating the ground surface (5); c) providing at least one anchoring system (1) such as the one described herein; d) evaluating parameters of the pole (3); e) manipulating the pole (3) and corresponding butt (69); f) manipulating the at least one anchoring system (1); and g) securing the least one anchoring system (1) onto the pole (3).

As can be easily understood when referring to the accompanying drawings, the above-mentioned anchoring method and/or corresponding steps may include including one and/or several of the following possible sub-steps, components and features (and/or different combination(s) thereof): i) the step of removing overburden from the ground surface (5); ii) the step of resting a butt (69) of the pole (3) directly onto a hard surface (71) of the ground surface (5); iii) the step of evaluating rock soundness of the ground surface (5); iv) the step of evaluating a slope of the ground surface (5); v) the step of ensuring that a maximum allowable slope in a hard surface (71) under the pole (3) is not greater than about 3 inches over the diameter of the pole butt (69); vi) the step of consulting a selection chart (65) to provide a number of anchoring systems (1) in accordance with given parameters of the pose (3); vii) the step of drilling a working surface (71) of the ground surface (5) using a corresponding rock drilling template (67); viii) the step of fitting an assembled template (73) to the pole butt (69); ix) the step of adjusting the assembled template (73) for a given size of the pole (3); x) the step of drilling at least one hole (75); xi) the step of ensuring that each hole (75) being drilled extends in a substantially parallel manner with respect to the pole (3); xii) the step of ensuring that each hole (75) being drilled points outwardly from the pole center (35); xiii) the step of beginning to drill at a highest point of a working surface (71) of the ground surface (5); xiv) the step of drilling a diameter hole (75) of about 2 inches to a depth of about 24 inches using a template (67); xv) the step of drilling a diameter hole (75) of about 3 inches to a depth of about 29 inches using a template (67); xvi) the step of inserting at least one anchor (77) for each corresponding hole (75) having been drilled; xvii) the step of loosely connecting saddles with corresponding studs; xviii) the step of erecting the pole (3) so as to hold the pole (3) in place in a substantially vertical manner; xix) the step of tightening each stud to grip the pole (3) within each saddle; xx) the step of ensuring that corresponding nuts are tightened; xxi) the step of tightening anchor bolts (49); xxii) the step of tightening anchor bolts (49) to a torque of about 400 N-m; xiii) the step of pre-drilling holes (75) into the pose (3); xxiv) the step of installing at least one lag bolt (63); xv) the step of grouting the pre-drilled holes (75); xvi) etc.

Referring back to the anchoring device or system (1), and as previously discussed, it is meant to anchor an upright or "vertical" structure, herein referred to also simply as a "pole" (3), as way of a possible example, to a hard ground surface (5). Such an anchoring system (1) can be used where it is not possible, desired, or indeed practical, for the pole (3) to be inserted, embedded, interred, etc., at least partially into the ground surface (5). The term "anchor" and/or "anchoring" as used herein to describe the device or system (1) refers to any device, tool, mechanism, apparatus, etc. which is able to attach to the pole (3) and which can be affixed to the ground surface (5), thereby securing the pole (3) in its orientation and allowing it to better resist any load which may be applied thereto. The term "structure" as used herein refers to any pole, bar, post, beam, mast, pile, plank, rod, shaft, etc., which extends from the hard surface (71) of the ground surface (5) in a substantially vertical manner. Similarly, the term "vertical" does limit the structure (12) to being "perpendicular" to the ground surface (5), and it is understood that in certain embodiments the structure (12) can extend at an inclination to the ground surface (5).

The hard ground surface (5) can be any rock, concrete, cement and/or other like material which can be difficult to penetrate, is impenetrable, and/or where it is not desired to penetrate it. Although the anchoring system (1) is described herein as being used to secure a pole (3) to a ground surface (5), the anchoring system (1) can also be used with a pole (3) that is embedded within the ground surface (5). It is thus understood that the anchoring system (1) can be used with vertical structures (12) that are embedded, even partially, within the ground surface (5).

Referring back to FIGS. 1, 5 and 36, the anchoring system (1) includes a plurality of support legs (9). The support legs (9) are intended to form the connection between the pole (3) and the ground surface (5), thereby anchoring the pole (3) to the ground surface (5). As such the term "leg" as used herein refers to any brace, member, pile, prop, stake, etc., capable of such functionality. Each support leg (9), when being used to help anchor the pole (3), extends at least partially into the ground surface (5), and furthermore extends outward of the ground surface (5) so as to attach to the pole (3). Optionally, the support legs (9) can be cylindrical hollow tubes which can be made from appropriate materials (e.g. metals, steel, hard polymers and/or other suitable materials or combinations thereof). Such tubes advantageously allow for less material to be used in the construction of the support legs (9), and further allow for objects to be inserted within support legs (9) and displaced therein.

Figure 39:
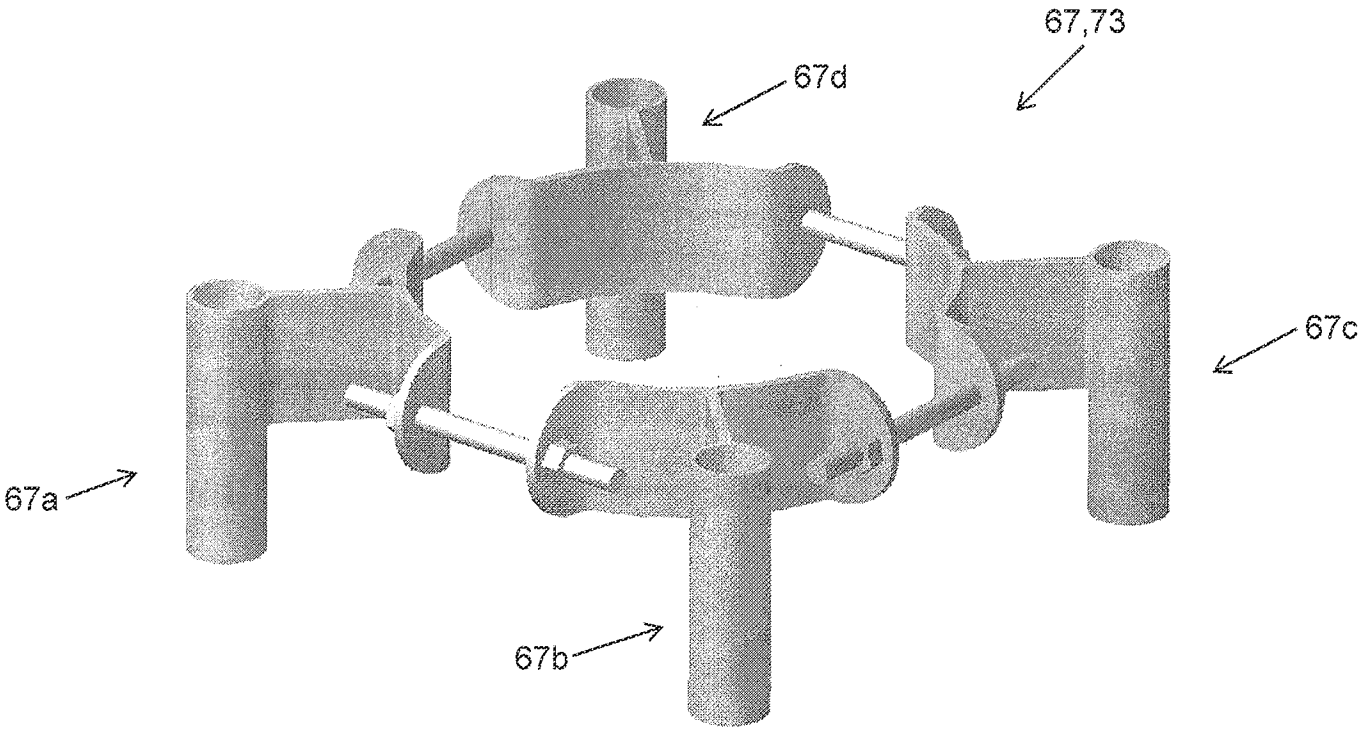
FIG. 39 is a perspective view of a drilling template provided with four straight template modules according to a possible embodiment of the present invention.
Figure 41:
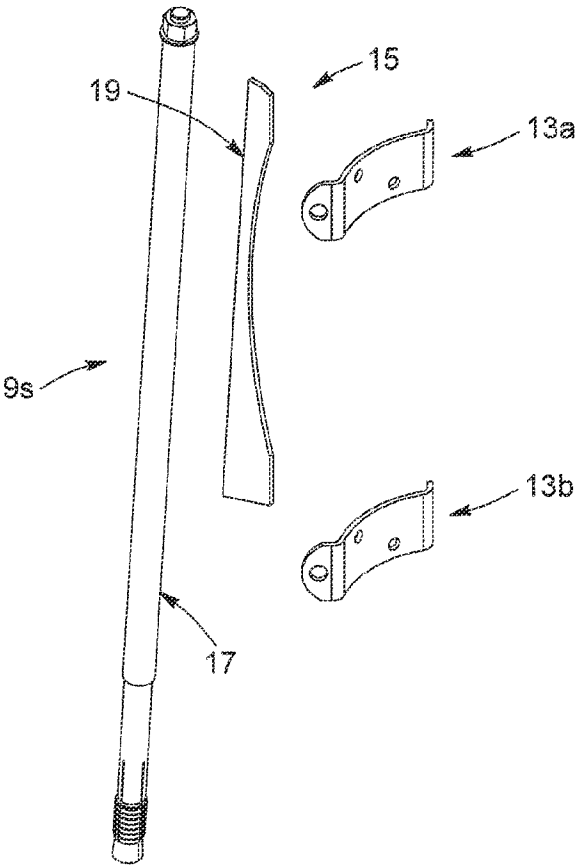
FIG. 41 is an exploded perspective view of a slanted anchoring module with two mounting interfaces according to a possible embodiment of the present invention.
Figure 40:
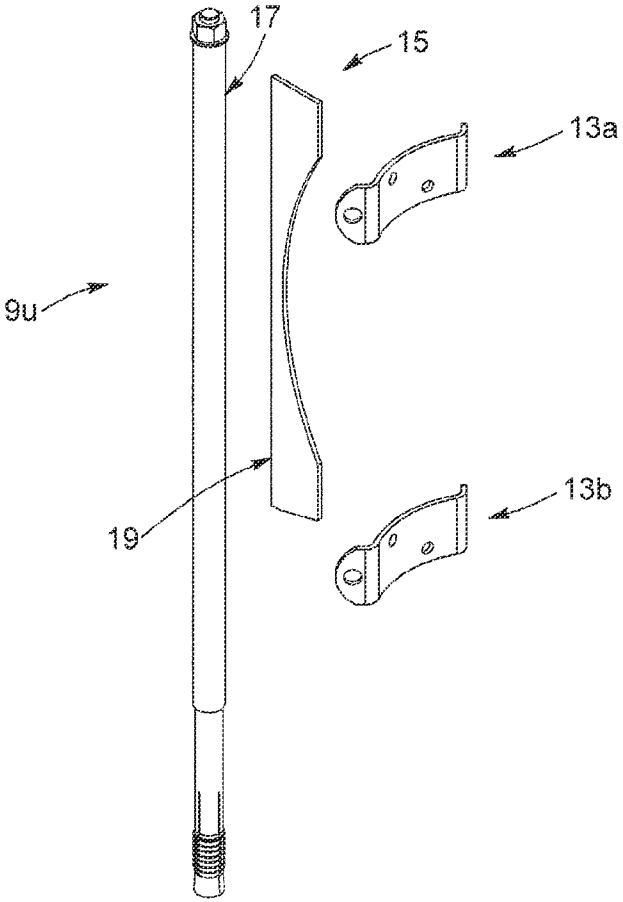
FIG. 40 is an exploded perspective view of an upright anchoring module with two mounting interfaces according to a possible embodiment of the present invention.
Figure 43:
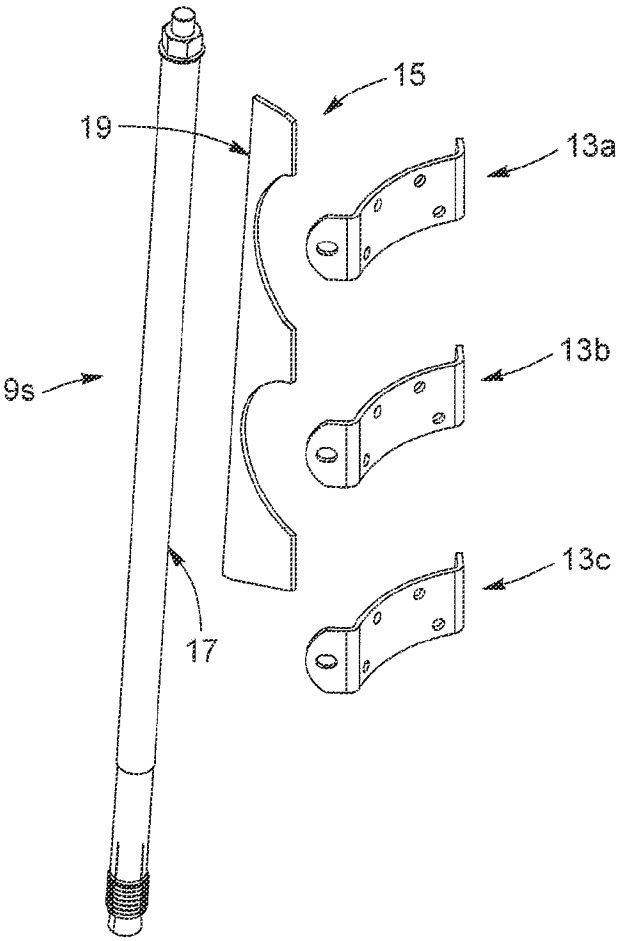
FIG. 43 is an exploded perspective view of a slanted anchoring module with three mounting interfaces according to a possible embodiment of the present invention.
Figure 42:
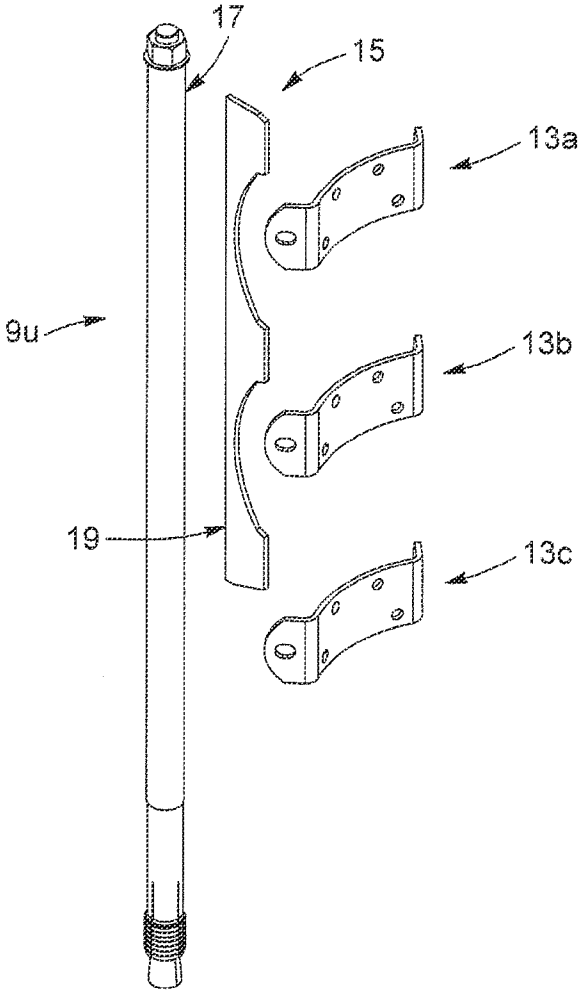
FIG. 42 is an exploded perspective view of an upright anchoring module with three mounting interfaces according to a possible embodiment of the present invention.
Figure 47:
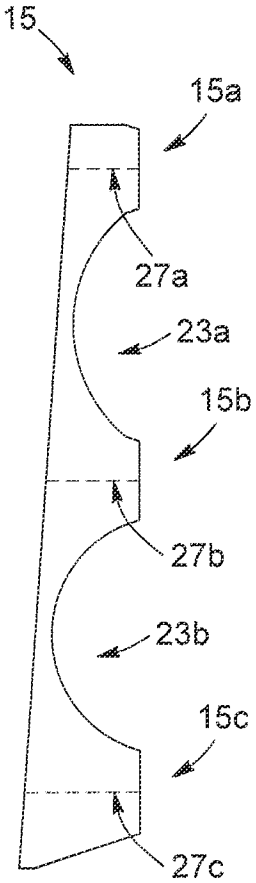
FIG. 47 is a side elevational view of the at least one connecting member of the anchoring module shown in FIG. 43.
Figure 46:
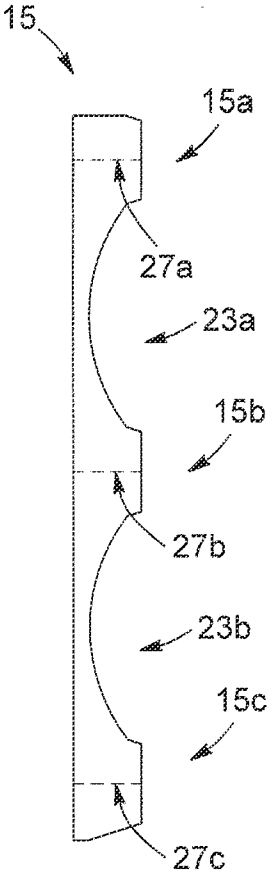
FIG. 46 is a side elevational view of the at least one connecting member of the anchoring module shown in FIG. 42.
Figure 45:
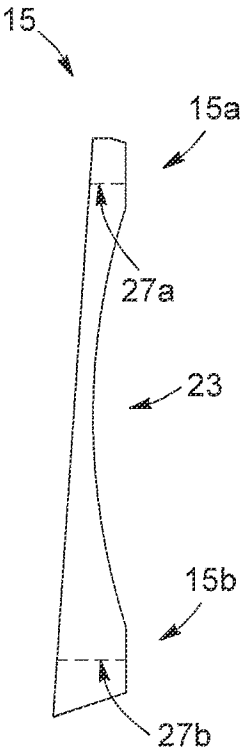
FIG. 45 is a side elevational view of the at least one connecting member of the anchoring module shown in FIG. 41.
Figure 44:
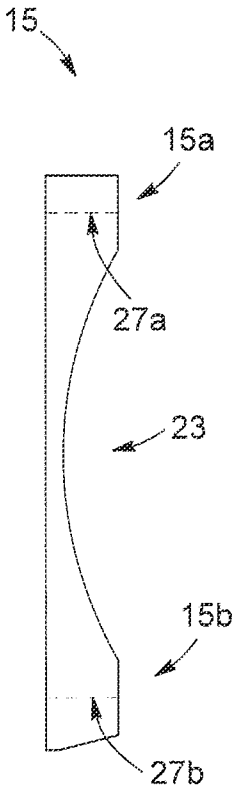
FIG. 44 is a side elevational view of the at least one connecting member of the anchoring module shown in FIG. 40.

In a typical configuration, but not the only possible configuration, bore holes and/or drill holes are bored into the ground surface (5), using a template (67,73) with corresponding template modules (67*a*,67*b*,67*c*,67*d*, etc.) such as the one illustrated in FIG. 39, for example. As can be easily understood, the template module (67) may have straight and/or slanted components depending on the type of holes to be drilled. In some instances, the holes can match the peripheral dimensions of the support legs (9), thereby ensuring that the support legs (9) fit tightly within the holes. The support legs (9) can then be inserted within the bore holes, thereby providing a proper anchoring of the support legs (9) within ground surface (5). In some optional embodiments, and as exemplified in FIG. 1, the holes can extend about 2 ft. below the level of the ground surface (5). It is of course understood that the depth of the holes can vary depending on numerous factors, such as, but not limited to: the loads to support, the number of support legs (9), the nature of the ground surface (5), etc. It will be appreciated that other possible depths are within the scope of the present disclosure, these depths depending upon, among other factors: the anticipated loads acting against support legs (9), the type of ground surface (5) (and/or working surface thereof (71)) being bored, and the length of the support legs (9). Similarly, the support legs (9) can extend about 4 ft, from the level of the ground surface (5), although other lengths are possible depending on some of the factors enumerated herein.

The orientation, form and/or disposition of the support legs (9) can vary. In a possible embodiment, the support legs (9) are between about 5 and about 6 ft. long, although other lengths are within the scope of the present disclosure. In another possible embodiment, the support legs (9) are inclined relative to a vertical axis so as to essentially "push against" the pole (3) when anchored within the ground surface (5). The angle at which support legs (9) are inclined can vary depending on numerous factors such as: the material from which the support leg (9) is made, the loads which the support leg (9) must resist, the nature of the ground surface (5) in which the support leg (9) is anchored, etc. In one possible embodiment, the support leg (9) is inclined at an angle of about four degrees relative to the vertical axis, although other possible angles of inclination are within the scope of the present invention. Furthermore, the length of the external periphery (e.g. diameter, circumference, etc.) of the support legs (9) can vary depending on the applications for which the support leg (9) is being used, and the loads it must resist, among some possible factors. In an optional embodiment, the support legs (9) are cylindrical tubes having a diameter of about 1.5 to about 3 in. It will of course be understood that other dimensions of the diameter and/or periphery are also possible.

In some optional embodiments, the number of support legs (9) can vary. Accordingly, in one possible embodiment, and as mentioned previously, a plurality of support legs (9) are spaced equidistantly around the periphery of the pole (3). For example, where the pole (3) is a cylindrical pole having a diameter of about 16 in., four support legs (9) can be installed and separated from one another at angles of about 90°. In another possible configuration where the pole (3) is a cylindrical pole having a diameter of about 12 in., the support legs (9) can number three support legs (9), each spaced at an angle of about 120° from each other. It is of course understood that the number of support legs (9) and/or their spacing from each other can vary depending on numerous factors, such as the disposition of loads acting against the pole (3), the nature of the ground surface (5) in which support legs (9) are anchored, the diameter/periphery of the pole (3), and the material from which support legs (9) are constructed, etc. Indeed, in some possible embodiments, the support legs (9) are not equidistantly spaced from each other around the periphery of pole (3), and can be mounted to support only one side of the pole (3). This configuration may be suitable where the loads acting against the pole (3) are unidirectional, or are constant and predictable.

In some optional embodiments, and referring to FIGS. 1, 5 and 36, each support leg (9) can include a gripping mechanism (41). The gripping mechanism (41) allows for the support leg (9) to be anchored and/or secured within the ground surface (5), either before or after the support leg (9) is affixed to the pole (3), thereby advantageously allowing the pole (3) to better resist the loads acting thereon.

Figures 21, 22, 23, 24:
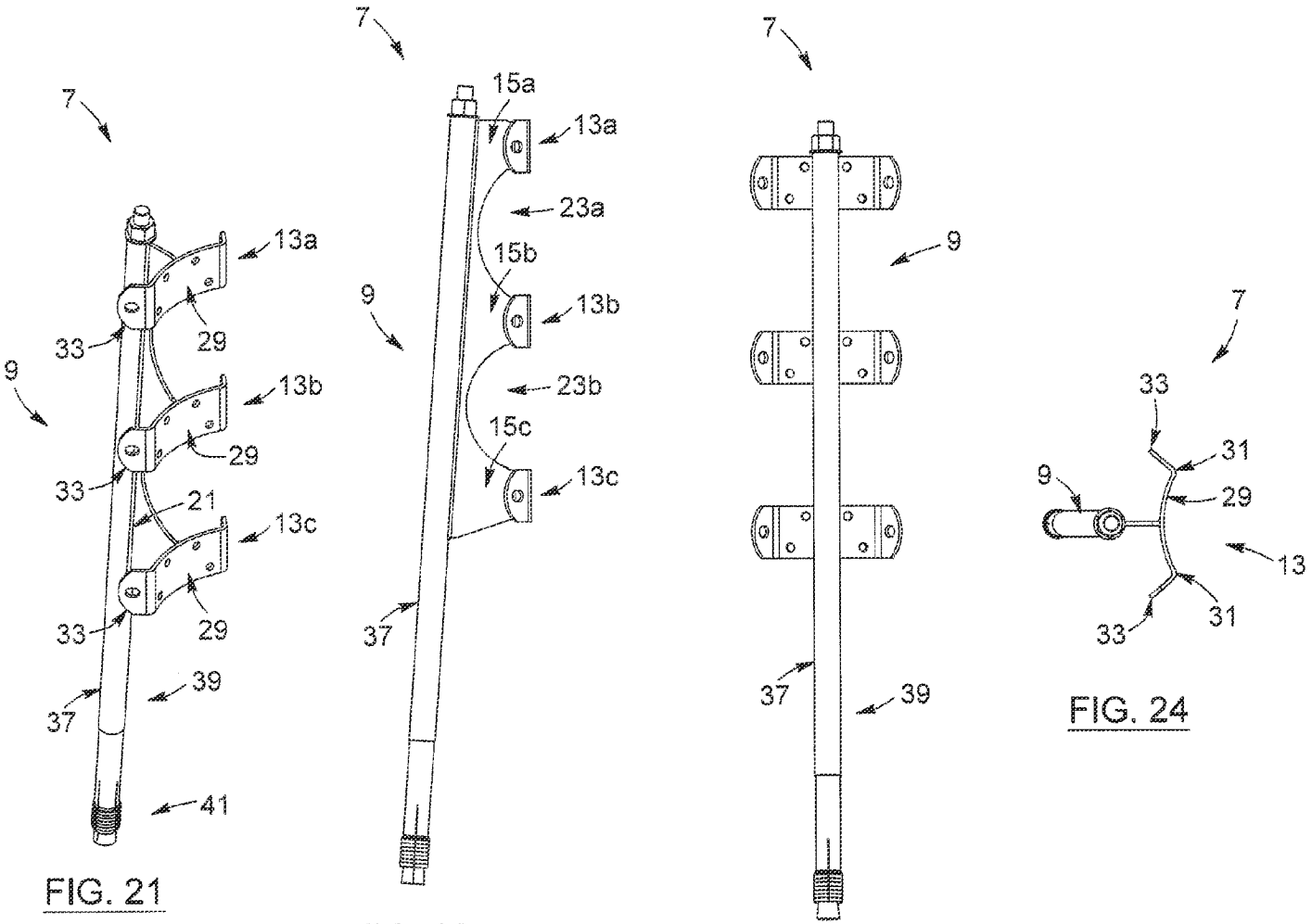
FIG. 21 is a front perspective view of a slanted anchoring module with three mounting interfaces according to a possible embodiment of the present invention.
FIG. 22 is a side elevational view of what is shown in FIG. 21
FIG. 23 is a rear elevational view of what is shown in FIG. 21.
FIG. 24 is a top plan view of what is shown in FIG. 21.
Figure 28:
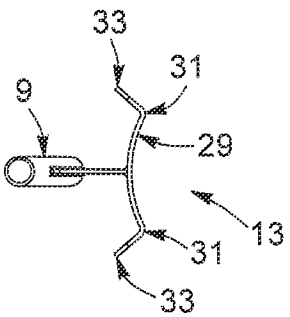
FIG. 28 is a bottom plan view of what is shown in FIG. 25.
Figure 27:
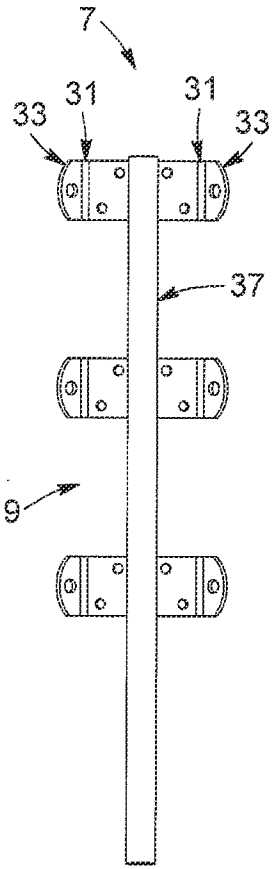
FIG. 27 is a rear elevational view of what is shown in FIG. 25.
Figure 26:
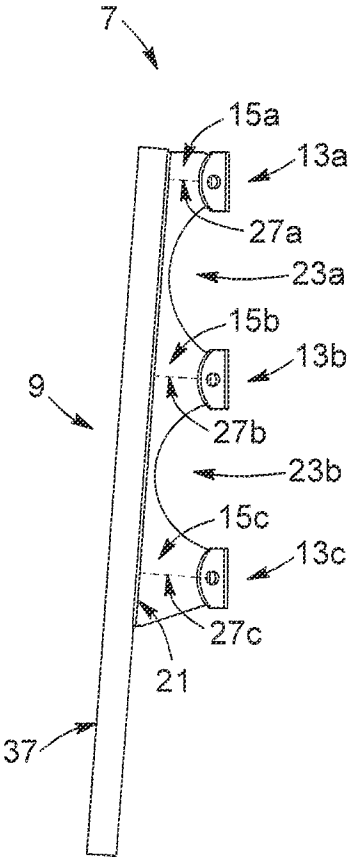
FIG. 26 is a side elevational view of what is shown in FIG. 25.
Figure 25:
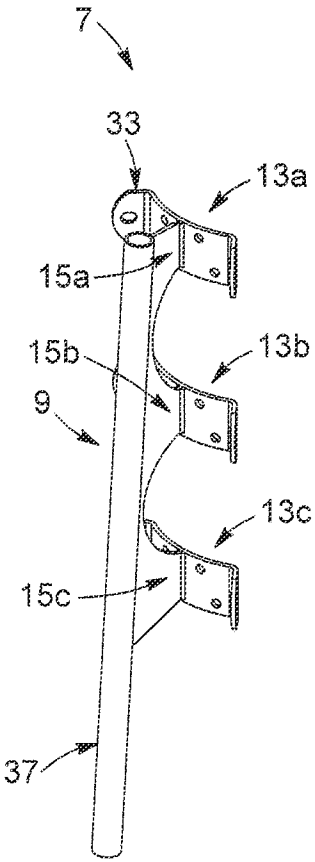
FIG. 25 is a rear perspective view of a slanted anchoring device with three mounting interfaces according to a possible embodiment of the present invention.
Figure 29:
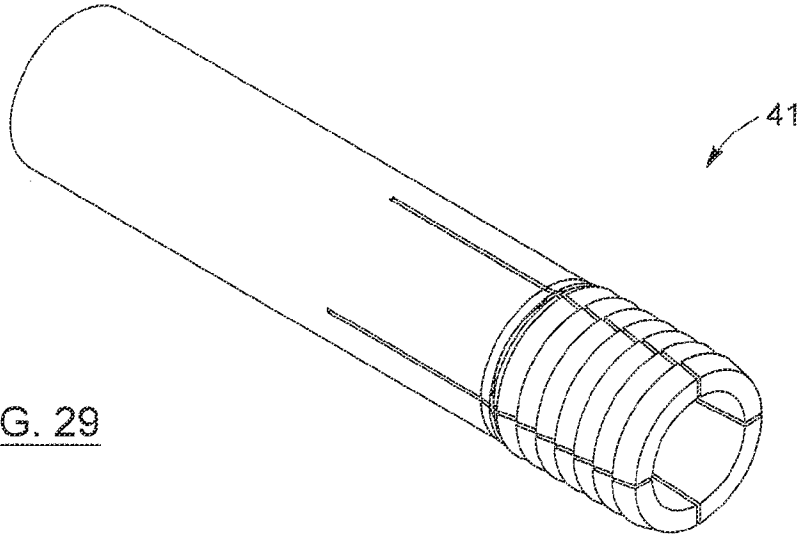
FIG. 29 is a partial perspective view of a gripping mechanism according to a possible embodiment of the present invention.
Figure 30:
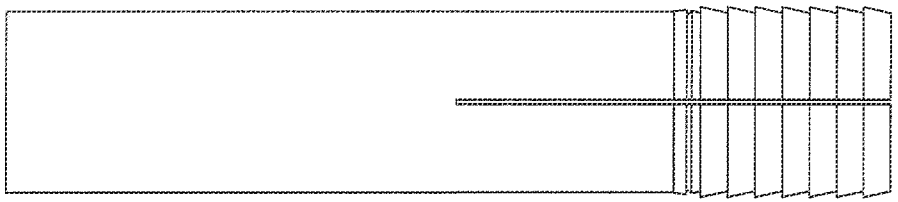
FIG. 30 is a side elevational view of what is shown in FIG. 29.
Figure 31:
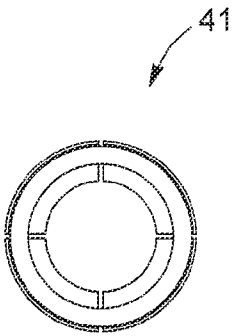
FIG. 31 is a front plan view of what is shown in FIG. 29.

An example of such a gripping mechanism (41) will now be described with reference to FIGS. 21-24 and 29-34. FIG. 21 shows a support leg (9) equipped with a gripping mechanism (41). The gripping mechanism (41) can consist of a tubular member which is a fraction of the length of the support leg (9), and it can be mounted within the support leg (9), which can consist of a tubular cylinder within which gripping mechanism (41) can be displaced.

Referring to FIGS. 29-34, the gripping mechanism (41) can be provided with a gripping interface. The gripping interface includes a ribbed and/or threaded end, which can interact with the ground surface (5) when inside the bore hole so as to grip the ground surface (5) surrounding the gripping interface, thereby securing the gripping interface and consequently, the support leg (9) within the ground surface (5). The gripping interface can be equipped with a plurality of slots which allow the end of the gripping interface adjacent to the ribbed end to expand into the ground surface (5) surrounding the gripping interface when it is inserted within the bore hole.

Figure 32:
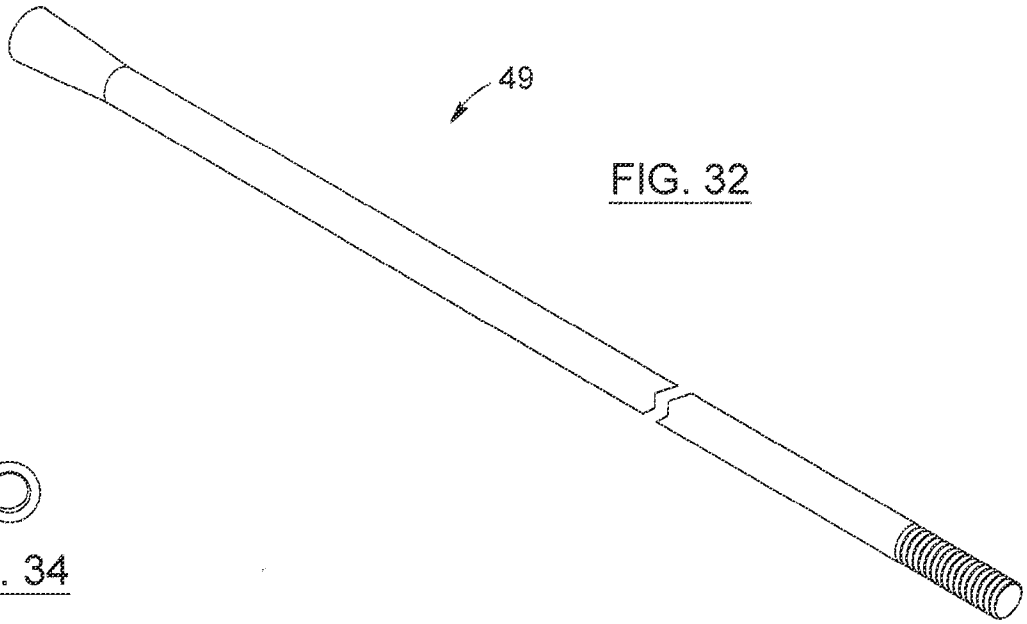
FIG. 32 is a perspective view of a rod with a flared cone according to a possible embodiment of the present invention.
Figure 33:
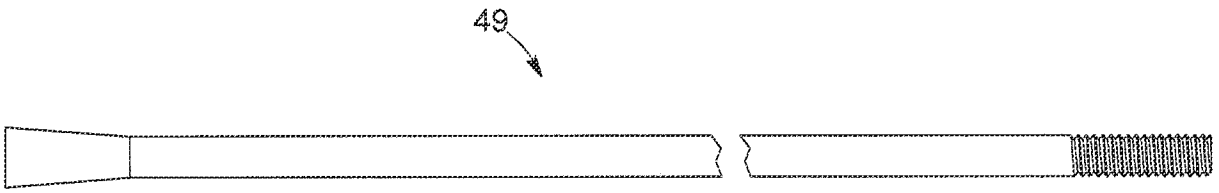
FIG. 33 is a side elevational view of what is shown in FIG. 32.
Figure 34:
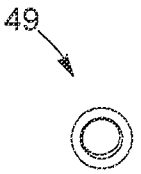
FIG. 34 is a front plan view of what is shown in FIG. 32.
Figure 35:
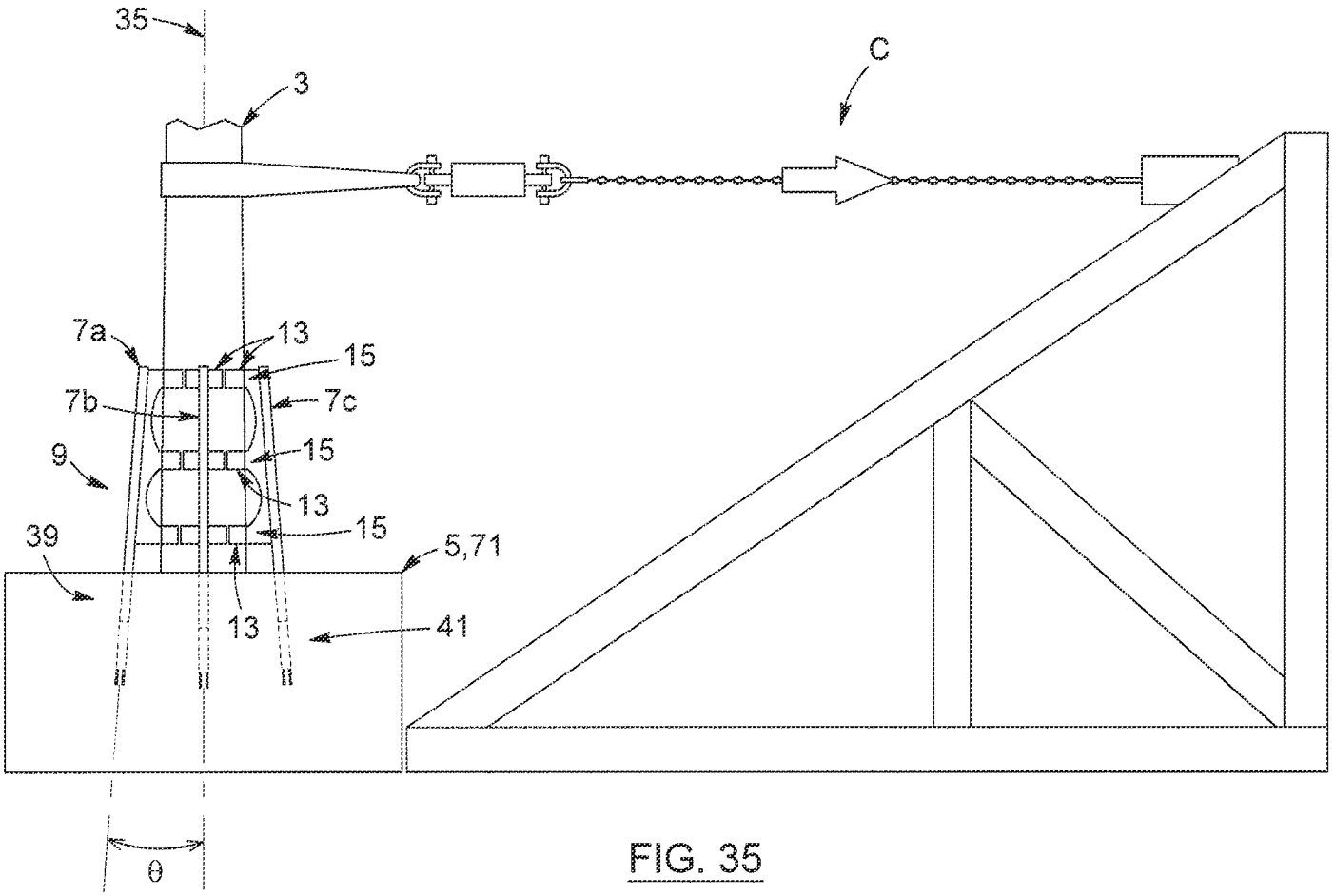
FIG. 35 is a schematic view of an experiment performed on an anchoring assembly according to a possible embodiment of the present invention.

Such an expansion of gripping interface can be accomplished by using an expansion rod, an example of which is illustrated in FIG. 32. The expansion rod can consist of two opposed ends. One end is provided with an outwardly-extending prong, which is opposed to the other end which can consist of a threaded end.

In an example of an operation for securing a support leg (9) to the pole (3) using the gripping mechanism (41), the support leg (9) can first be assembled by inserting the gripping interface within the lower end of the support leg (9). Then, the expansion rod can be inserted into the support leg (9) by inserting the threaded end through the gripping interface until the threaded end exits from the opposite end of the support leg (9). The support leg (9) can then be attached to the pole (3). When so attached, the support leg (9) can be anchored and/or "torqued" so that the opposite end of the support leg (9), which is not secured to the pole (3) and which is inserted into the bore hole, can be anchored to the ground surface (5). Such an anchoring operation can include placing a nut on the threaded end. As the nut is tightened, thereby drawing the expansion rod upward relative to the support leg (9), prong is also drawn upward and abuts against the inside surface of the ribbed end. The slots allow the ribbed end to expand outwardly when abutted by the prong, thereby pushing the ribs of ribbed end into the adjacent ground surface (5), and thus increasing the force required to remove the support leg (9) from the ground surface (5). It can thus be understood how such an anchoring operation secures the support leg (9) within the ground surface (5). Of course, other techniques for anchoring and/or securing the support leg (9) within the ground surface (5) are within the scope of the present disclosure, and the above-mentioned example of an anchoring operation does not limit the present disclosure to only said example.

Each support leg (9) also includes a link or "webbing". The link forms a continuous connection between the support leg (9) and a plurality of separate mounting interfaces, which are further discussed below, returning now to FIGS. 1-28, such a continuous connection or "webbing" allows for the support leg (9) to receive the loads applied against mounting interfaces (13), and may further allow for the loads acting against individual mounting interfaces (13) to be better distributed amongst the remaining mounting interfaces (13) and/or the support leg (9). The continuous connection allows the loads acting against a particular mounting interface (13) to be supported by all mounting interfaces (13), as such loads can be transmitted through the continuous connection provided by the link. The expression "extending between a length" of the support leg (9) is used herein to refer to the fact that link (or "webbing") occupies a length of the support leg (9). The length occupied may vary. In some possible configurations, the length can occupy half of the total length of the support leg (9), and in other possible configurations, the length can occupy the entirety of the length of the support leg (9). Any combination and/or variation between these two lengths is also possible and within the scope of the present disclosure. The above-described connecting member (15) (i.e. link, webbing, etc.) can be made of any suitable materials which can include metals, steel, hardened polymers and/or any combination of these, or other similar materials.

This link can have many possible configurations. As such, the link can be any flange, projection, web, buttress, etc., which extends between the support leg (9) and the mounting interfaces (13) so as to form the above-described continuous connection.

In one possible configuration, the link can consist of a "web" structure where at its furthest extremities, it connects to the mounting interfaces (13). In between such extremities, the link descends towards the surface of the support leg (9), these descents forming semi-circular indentations, an example of which is shown in FIGS. 9-11 and 17-19. In another possible configuration, the link can be a uniform block (ex. simple and full rectangle, etc.) which links all mounting interfaces (13) together and which links as well to the support leg (9). The connection to the support leg (9) can be made using techniques such as welding, adhesives and/or mechanical fasteners. In yet another possible configuration, the link is a perforated, "grid-like" structure. Such a link can consist of spars extending from the surface of the support leg (9) toward the mounting interfaces (13). These spars can be linked by other perpendicularly and/or angularly intersecting spars which connect the mounting interfaces (13) together, thereby allowing the mounting interfaces (13) and the support leg (9) to form a continuous connection. in yet another possible configuration where the support leg (9) is inclined, an example of which is illustrated in FIGS. 13-15 and 21-23, the extension of the link away from the support leg (9) can vary along the length of the support leg (9). For example, the link extends a relatively small distance away from the support leg (9) to reach the mounting interface (13) at the top of the support leg (9), and extends an increasingly larger distance for each mounting interface (13) lower down the support leg (9). This configuration advantageously allows for the mounting interfaces (13) disposed at the top of the support leg (9) to be in vertical alignment with the mounting interfaces (13) towards the bottom of the support leg (9). Of course, other possible configurations of the link not described herein are within the scope of the present disclosure, and the above-mentioned optional embodiments do not limit the link to only said embodiments.

In light of the preceding, it can thus be appreciated how the link forms a continuous connection between mounting interfaces (13) and support leg (9), thereby allowing for an optimized distribution of loads transmitted to the support leg (9) by the pole (3).

As previously discussed, and now referring to FIGS. 1, 5 and 36, a plurality of mounting interfaces (13) are fixed to the link for being removably attached to pole (3), thereby securing the support leg (9) to the pole (3). By "removably attached", it is understood that the mounting interfaces (13) can be affixed to the pole (3), and can then be removed therefrom. The mounting interfaces (13) may include a mounting surface (29) which abuts against the exterior of the pole (3) so as to secure the mounting interface (13) thereto. The mounting surface (29) can take any form or configuration, and can also be adapted to conform to the shape of the exterior of pole (3). In optional embodiments where the pole (3) is cylindrical, the mounting surface (29) can be curved (i.e. saddled, etc.) and can include a curvature substantially corresponding to the curvature of the exterior of the pole (3). In so doing, the mounting interface (13) can form an attachment with the pole (3), thereby advantageously allowing the mounting interlace (13) to be better secured to the pole (3).

The mounting surface (29) can also be equipped with apertures and/or through-holes for inserting fastening means therethrough, thereby securing the mounting interface (13) to the pole (3). Other fastening and/or connection techniques for connecting the mounting interface (13) to the pole (3) are within the scope of the present disclosure. In some embodiments, the mounting interface (13) includes outwardly projecting wings (33). These wings (33) allow each mounting interface (13), and thus each support leg (9), to connect to one another. In one example, as the mounting interfaces (13) of one support leg (9) are affixed to the pole (3), an adjacent support leg (9) can also be fixed to the pole (3). The mounting interfaces (13) of the adjacent support legs (9) can connect to each other through their respective wings (33). As wings (33) of adjacent mounting interfaces (13) are brought within proximity of each other, a fastening device (e.g. a bolt) can join the wings (33) together and can be tightened, thereby securing adjacent wings (33) together, and thus adjacent mounting interfaces (13) and support legs (9) together. Such a configuration can be used to connect all the support legs (9) around the pole (3), thereby reinforcing the anchorage provided by each support leg (9), and advantageously allowing the support legs (9) to collectively support the loads generated by the pole (3).

According to another aspect of the invention, there is provided a kit comprising any and/or all of the components described above. Such a kit can be assembled on site, thereby anchoring the pole (3) mounted to the ground surface (5). Similarly, a pole (3) such as a pole, for example, can be provided with any and/or all of the components of the device and/or system described above.

The invention claimed is:

1. An anchoring system for anchoring a pole to a ground surface, the anchoring system comprising a plurality of modules interconnectable to one another for surrounding the pole, each module comprising a support leg configured for extending into the ground surface to provide anchoring support to the pole on a given side of said pole, said each module of the anchoring system further comprising at least two mounting interfaces disposed distally from the support leg and configured for resting against the pole, and said each module of the anchoring system further comprising at least one connecting member extending from an edge of the support leg to a corresponding mounting interface, said at least one connecting member further operatively extending between said at least two mounting interfaces; said at least one connecting member comprising a support leg section extending along a segment of the edge of the support leg, the support leg sections of adjacent connecting members forming a continuous link between said adjacent connecting members.

2. An anchoring system according to claim 1, wherein the at least one connecting member of a first mounting interface comprises a sub-portion connecting the first mounting interface to the support leg and another sub-portion operatively connecting the first mounting interface to a second adjacent mounting interface.

3. An anchoring system according to claim 2, wherein the at least one connecting member of the first mounting interface comprises the sub-portion connecting the first mounting interface to the support leg and another sub-portion operatively connecting the first mounting interface to a third subsequent lower mounting interface.

4. An anchoring system according to any claim 1, wherein the at least one connecting member of a given first mounting interface comprises a sub-portion connecting said given first mounting interface to the support leg and another sub-portion directly connecting said given first mounting interface to at least one other mounting interface of the anchoring module.

5. An anchoring system according to claim 1, wherein the at least one connecting member and sub-portions thereof form a single piece interconnecting the at least two mounting interfaces.

6. An anchoring system according to claim 1, wherein the at least one connecting member includes at least on arcuate segment opposite to the edge of the support leg, and extending between adjacent mounting interfaces.

7. An anchoring system according to claim 1, wherein the at least one connecting member comprises a first and second arcuate segments, the first arcuate segment extending between first and second adjacent mounting interfaces, and the second arcuate segment extending between second and third adjacent mounting interfaces.

8. An anchoring system according to claim 1, wherein at least one given module of the system comprises an upright support leg configured to be substantially parallel relative to the pole when anchored into the ground surface.

9. An anchoring system according to claim 1, wherein at least one given module of the system comprises a slanted support leg configured to be inclined relative to the pole when anchored into the ground surface.

10. An anchoring system according to claim 1, wherein the system comprises n modules being interconnectable to one another for surrounding the pole, n being the number of support legs, each support leg being separated from an adjacent support leg by an angular interval of about 360°/n upon the mounting interfaces of each support leg being secured to the pole, n being greater than or equal to 2.

11. An anchoring system according to claim 1, wherein each mounting interface comprises a mounting surface for engaging with a surface of the pole.

12. An anchoring system according to claim 11, wherein each mounting surface has a curvature substantially corresponding to a curvature of the surface of the pole, and each mounting interface has opposed extremities, each extremity being provided with a wing extending away from said extremity, each wing of a given mounting interface of a first support leg being configured for interconnecting with a corresponding wing of a mounting interface of an adjacent second support leg.

13. An anchoring system according to claim 1, wherein each support leg is inclined at a support leg angle relative to a vertical axis of the pole, and wherein said support leg angle is between about 0° and about 10°.

14. An anchoring system according to claim 1, wherein each support leg includes a cylindrical hollow-tube, a ground-surface end being securable into the ground surface, and a gripping mechanism for gripping into the ground surface.

15. An anchoring system according to claim 1, wherein each support leg is between about 5-feet and about 6-feet long, and has a diameter between about 1.5 inches and about 3 inches.

16. An anchoring system according to claim 1, wherein the at least one connecting member of a first mounting interface comprises a sub-portion connecting the first mounting interface to the support leg and another sub-portion operatively connecting the first mounting interface to a second adjacent mounting interface; wherein each connecting member comprises a support-leg section extending along a segment of the edge, and wherein support-leg sections of adjacent connecting members form a continuous link between said adjacent connecting members; wherein the at least one connecting member and sub-portions thereof form a single piece interconnecting the at least two mounting interfaces; and wherein the at least one connecting member includes at least one arcuate segment opposite to the edge of the support leg, and extending between adjacent mounting interfaces; wherein the system comprises n modules being interconnectable to one another for surrounding the pole, n being the number of support legs, each support leg being separated from an adjacent support leg by an angular interval of about 360°/n upon the mounting interfaces being secured to the pole, n being greater than or equal to 2; wherein each mounting interface comprises a mounting surface for engaging with a surface of the pole; wherein each mounting surface has a curvature substantially corresponding to a curvature of the surface of the pole, and each mounting interface has opposed extremities, each extremity being provided with a wing extending away from said extremity, each wing of a given mounting interface of a first support leg being configured for interconnecting with a corresponding wing of a mounting interface of an adjacent second support leg; wherein each support leg is inclined at a support leg angle relative to a vertical axis of the pole, and wherein said support leg angle is between about 0° and about 10°; and wherein each support leg includes a cylindrical hollow-tube, a ground-surface end being securable into the ground surface, and a gripping mechanism for gripping into the ground surface.

17. An anchoring assembly for anchoring a pole to a ground surface, the anchoring assembly comprising:

at least one anchoring system according to claim 1 or 16; and at least one module component configured for use with said at least one anchoring system.

18. An anchoring assembly according to claim 17, wherein the at least one module component is selected from the group consisting of forge anchor bolt (49), expansion shell, welded pipe, washer and nut.

19. An anchoring assembly according to claim 17, wherein the anchoring assembly comprises at least one field component configured for use with the at least one module component, the at least one field component being selected from the group consisting of stud, nut and lag bolt.

20. An anchoring assembly according to claim 17, wherein the anchoring assembly comprises at least one pole to be anchored to the ground surface.

21. A method of anchoring a pole and corresponding butt to a ground surface, wherein the method comprises the steps of:

evaluating parameters of the ground surface;

manipulating the ground surface;

providing at least one anchoring system according to claim 1;

evaluating parameters of the pole;

manipulating the pole and corresponding butt;

manipulating the at least one anchoring system; and securing the least one anchoring system onto the pole.

22. A method according to claim 21, wherein the method comprises one of the following additional steps:

i) the step of removing overburden from the ground surface;

ii) the step of resting a butt of the pole directly onto a hard surface of the ground surface;

iii) the step of evaluating rock soundness of the ground surface;

iv) the step of evaluating a slope of the ground surface;

v) the step of ensuring that a maximum allowable slope in a hard surface under the pole is not greater than about 3 inches over the diameter of the pole butt;

vi) the step of consulting a selection chart to provide a plurality of anchoring systems in accordance with given parameters of the pole;

vii) the step of drilling a working surface of the ground surface using a corresponding rock drilling template;

viii) the step of fitting an assembled template to the pole butt;

ix) the step of adjusting the assembled template for a given size of the pole;

x) the step of drilling at least one hole;

xi) the step of ensuring that each hole being drilled extends in a substantially parallel manner with respect to the pole;

xii) the step of ensuring that each hole being drilled points outwardly from the pole center;

xiii) the step of beginning to drill at a highest point of a working surface of the ground surface;

xiv) the step of drilling a diameter hole of about 2 inches to a depth of about 24 inches using a template;

xv) the step of drilling a diameter hole of about 3 inches to a depth of about 29 inches using a template;

xvi) the step of inserting at least one anchor for each corresponding hole having been drilled;

xvii) the step of loosely connecting saddles with corresponding studs;

xviii) the step of erecting the pole so as to hold the pole in place in a substantially vertical manner;

xix) the step of tightening each stud to grip the pole within each saddle;

xx) the step of ensuring that corresponding nuts are tightened;

xxi) the step of tightening anchor bolts;

xxii) the step of tightening anchor bolts to a torque of about 400 N-m;

xiii) the step of pre-drilling holes into the pole;

xxiv) the step of installing at least one lag bolt;

xv) the step of grouting the pre-drilled holes.

* * * * *